US005577280A

United States Patent [19]

Elliott

[11] Patent Number: 5,577,280

[45] Date of Patent: Nov. 26, 1996

[54] SNAP-TOGETHER ADJUSTABLE, ARTICULATED BED

[75] Inventor: Franklin E. Elliott, Culver City, Calif.

[73] Assignee: Maxwell Products, Inc., Cerritos, Calif.

[21] Appl. No.: 404,326

[22] Filed: Mar. 15, 1995

Related U.S. Application Data

[63] Continuation-in-part of Ser. No. 213,675, Mar. 15, 1994, Pat. No. 5,537,701.

[51] Int. Cl.[6] ..... A61G 7/00

[52] U.S. Cl. ..... 5/618; 5/620; 5/617

[58] Field of Search ..... 5/600, 610, 611, 5/612, 613, 616, 617, 618, 624, 620

[56] References Cited

U.S. PATENT DOCUMENTS

| | | |
|---|---|---|
| Des. 255,402 | 6/1980 | Lundgren . |
| 607,011 | 7/1898 | Bennett . |
| 660,196 | 10/1900 | Myers . |
| 683,137 | 9/1901 | Myers . |
| 714,733 | 12/1902 | Newell . |
| 723,569 | 3/1903 | Witzel . |
| 725,330 | 4/1903 | Foster . |
| 954,620 | 4/1910 | Gail . |
| 1,132,614 | 3/1915 | Payne . |
| 1,205,183 | 11/1916 | Frank . |
| 1,658,736 | 2/1928 | Ortmeier . |
| 1,851,282 | 3/1932 | Jacobs . |
| 2,203,780 | 6/1940 | Gatz . |
| 2,500,742 | 3/1950 | Taylor . |
| 2,996,732 | 1/1959 | Draper . |
| 3,220,021 | 11/1965 | Nelson . |
| 3,237,212 | 3/1966 | Hillenbrand et al. . |
| 3,242,507 | 3/1966 | Peterson . |
| 3,402,408 | 9/1968 | Hutt . |
| 3,581,320 | 4/1969 | Degen . |
| 3,593,350 | 7/1971 | Knight et al. . |
| 3,644,946 | 2/1972 | Swatt . |
| 3,680,448 | 8/1972 | Ballingall et al. . |
| 3,683,429 | 8/1972 | Mis . |
| 3,686,696 | 8/1972 | Lanigan . |
| 3,693,200 | 9/1972 | Stafford . |
| 3,793,652 | 2/1974 | Linehan et al. . |
| 3,898,702 | 8/1975 | Goodman . |
| 3,919,727 | 11/1975 | Paine . |
| 3,965,500 | 6/1976 | Stein, Jr. . |
| 4,005,497 | 2/1977 | Sutter . |
| 4,057,240 | 11/1977 | Damico et al. . |
| 4,095,296 | 6/1978 | Ferro . |
| 4,202,062 | 5/1980 | Marcyan . |
| 4,204,286 | 5/1980 | Stiles et al. . |
| 4,218,788 | 8/1980 | Steckmesser . |
| 4,225,988 | 10/1980 | Cary et al. . |
| 4,227,269 | 10/1980 | Johnston . |
| 4,258,445 | 3/1981 | Zur . |

(List continued on next page.)

FOREIGN PATENT DOCUMENTS

| | | |
|---|---|---|
| 5189 | 2/1896 | United Kingdom . |
| 5289 | 4/1906 | United Kingdom . |

*Primary Examiner*—Michael F. Trettel
*Attorney, Agent, or Firm*—Poms, Smith, Lande & Rose, P.C.

[57] ABSTRACT

An adjustable articulated bed manufactured in seven or so components for packing in three or so separate smaller boxes for easy transport. These components can be snap-fit together for easy assembly (and disassembly). The bed includes a bed frame, a power module or carriage and a bedding foundation. The foundation in turn includes a head portion and a body portion both of which are snap-fit securable in position to the power carriage. Pins releasably hold the roller assemblies of the power carriage to side rails of the frame for rolling moving of the carriage on the frame. A motor of the power carriage controllably moves the foundation head portion with respect to the frame and body portion. A drag link pivotally connects the head portion to the head rail of the frame. The drag link can be releasably connected at either end thereof or in the middle, snapping the two parts of the drag link together. The lateral rails, longitudinal rails and corner posts can be disassembled into four pieces with wedge-cup arrangements or rotatable camming locks.

82 Claims, 19 Drawing Sheets

U.S. PATENT DOCUMENTS 4,307,477 12/1981 Jacobsen .
4,336,621 6/1982 Schwartz et al. .
4,344,422 8/1982 Immel .
4,361,917 12/1982 Wilson .
4,371,996 2/1983 Nahum .
4,376,316 3/1983 Mercier et al. .
4,380,838 4/1983 Lutchansky .
4,381,571 5/1983 Elliott .
4,385,410 5/1983 Elliott et al. .
4,407,030 10/1983 Elliott .
4,494,259 1/1985 Millet et al. .
4,527,298 7/1985 Moulton .
4,536,904 8/1985 Whithead .
4,559,655 12/1985 Peck .
4,674,140 6/1987 Boonants et al. .
4,742,586 5/1988 Galumbeck .
4,839,932 6/1989 Williamson .
4,893,365 1/1990 Justice .
4,899,404 2/1990 Galumbeck .
4,996,731 3/1991 Kruyt .
5,129,117 7/1992 Celestina et al. .
5,160,010 11/1992 Peterson .
5,165,129 11/1992 Rohm .
5,195,198 3/1993 Travis .
5,205,004 4/1993 Hayes et al. .
5,224,228 6/1993 Larrimore .
5,245,718 9/1993 Krauska .
5,315,726 5/1994 Borenstein .
5,329,657 7/1994 Barley et al. .
5,404,604 4/1995 Has et al. .

FIG. 14
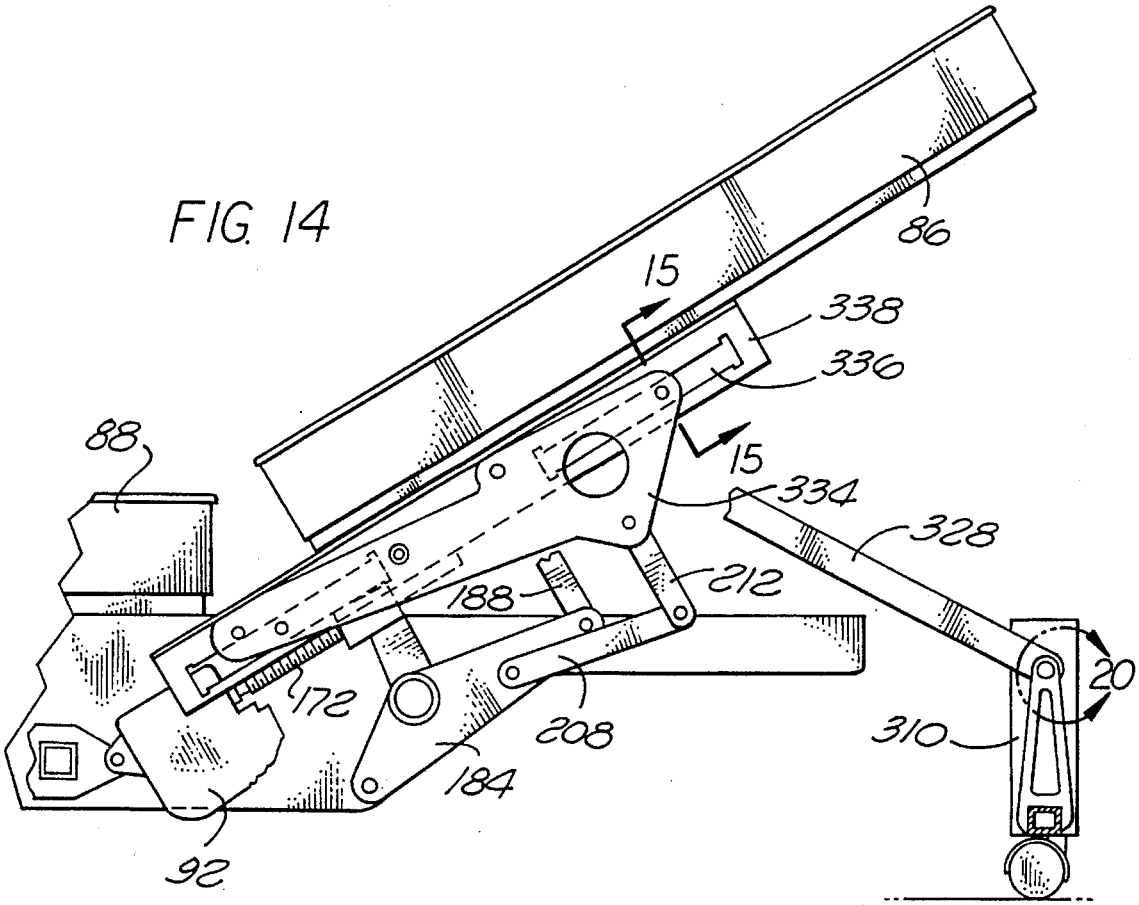
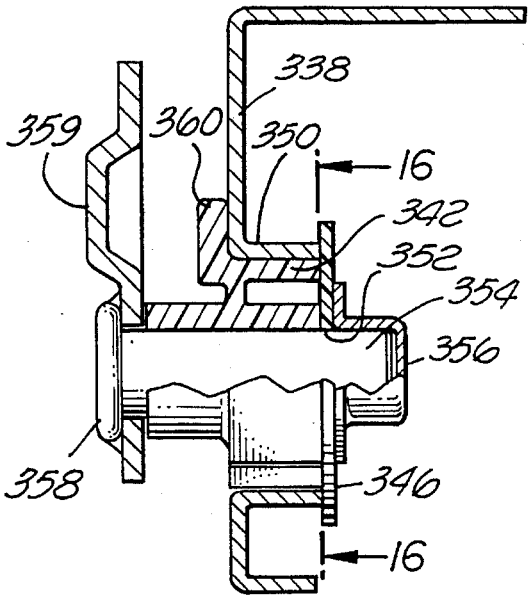
FIG. 15
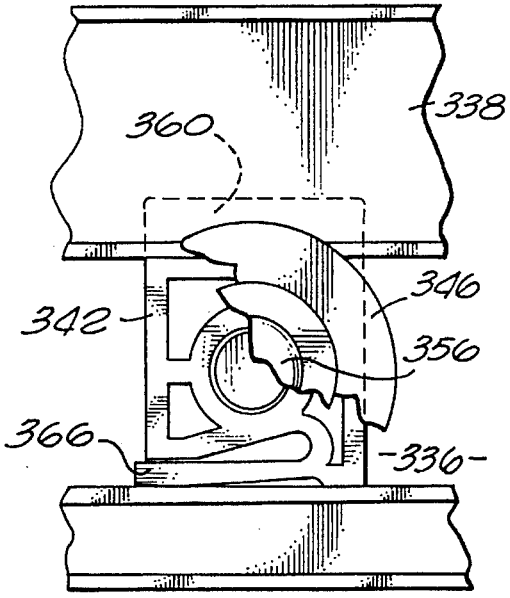
FIG. 16

SNAP-TOGETHER ADJUSTABLE, ARTICULATED BED

CROSS REFERENCE TO RELATED APPLICATION

This is a continuation-in-part of application Ser. No. 08/213,675, filed Mar. 15, 1994, now U.S. Pat. No. 5,537,701 whose entire contents are hereby incorporated by reference.

BACKGROUND OF THE INVENTION

The present invention relates generally to articulated beds having a foundation and a mattress thereon and which are adjustable to provide the desired contoured support to the user lying on the mattress. It more particularly relates to such beds which are driven by one or more electrical motors and whose head portion can be pivoted by that motor between a flat orientation and a raised orientation. It further relates to adjustable articulated beds whose components can be snap-fit together. It also concerns methods for transporting and assembling knock-down adjustable beds.

Adjustable beds have been used for many years to alter the contours of top surfaces of mattresses to thereby adjust the support on the different portions of the bodies of persons lying on them. This support adjustment can be for therapeutic purposes, for comfort reasons, or for the user's convenience, as when the user wants to sit propped up to read, eat or watch television. Originally, this adjustment was by manually-operated mechanical levers or cranks. Later, these manually-operated mechanical devices were replaced by one or more motors which drove the adjustable bed into the desired position through gear trains, chain drives, sprocket drives, and/or threaded shafts.

Adjustable beds are typically used in hospitals or convalescent homes by patients who must spend long periods of time in bed for health, injury or physical handicap reasons. The use of adjustable beds in private homes has increased markedly though in recent years. This is due to the popularity of home television and video viewing, the aging of the population and the technical advances which have been made in the construction, operation and capabilities of adjustable beds.

Examples of adjustable beds known in the prior art are shown in U.S. Pat. Nos. 4,381,571 (Elliott), 4,385,410 (Elliott et al) and 4,407,030 (Elliott). All of these patents are owned by the present assignee and are hereby incorporated by reference. Additionally, an adjustable bed representative of the prior art is illustrated generally at 50 in FIG. 1 and discussed below.

The conventional adjustable bed 50 has a motor-driven, articulated bed platform plate for supporting and moving equal-length top and foundation mattresses 54, 56. The foundation mattress 56 is usually a cloth-covered foam layer glued to the articulated platform plate, or it can be a box spring similarly attached. When the bed 50 is flat, which is its normal position, the top and foundation mattresses 54, 56 are the same length. When the bed platform shown generally at 57 is operated to cause the mattresses 54, 56 to assume curved shapes, as shown in FIG. 1, the length of the mostly concave top surface of the foundation mattress is noticeably shortened relative to the mostly convex bottom surface of the top mattress. The user's buttocks often are pinched in the crease of the mattress, as shown by reference numeral 58. Also, as the head sections of the mattresses are pivotally raised, an undue amount of compression is placed on the lower mattress 56 at the crease or bend.

The conventional adjustable bed 50 has a footboard or mattress guard 60 to restrain the foot of the top mattress 54 from projecting beyond the foot of the foundation mattress 56. When the bed 50 is curved, the top mattress 54 rides up over the foundation mattress 56 so the head of the top mattress extends beyond the head of the foundation mattress. The top mattress 54 thereby overhangs the bottom foundation 56, as shown generally by reference numeral 62, adversely effecting the wear and comfort features of the head portion of the mattress 54. Also, the frictional sliding of the top mattress 54 over the foundation mattress 56 dissipates energy, increasing the work that must be performed by the motor which adjusts the bed platform plate. In addition when raising the head end of the mattress 54 towards the foot of the bed 50, stationary nearby objects which were originally near the head of the user 64, for example a lamp 66, a radio or a telephone 68 on adjacent night tables or night stands 70, 72, are now behind the user and out of his or her convenient reach.

Another problem with the prior art adjustable articulated beds is that they are difficult to transport to the end user and assemble. Often they are transported in a single large box having dimensions of 60"×81"×21" and weighing two hundred and eight pounds. The large box requires two (or more) delivery men to carry it to the user's desired location. This can be very tiring or dangerous if the box must be carried long distances or up many steps. Because of its size dimensions it is also very awkward for the delivery men to negotiate it up narrow winding staircases. Additionally, the size dimensions can make it difficult to pack the box efficiently and compactly in the storage compartments of the transport vehicle(s).

Examples of bed frames for non-motorized beds which can be broken down are shown in U.S. Pat. Nos. 683,137 (Myers), 714,733 (Newell), 723,569 (Witzel), 725,330 (Foster), 1,205,183 (Frank), 3,683,429 (Mis), and 4,536,904 (Whithead), and UK 5,189 and UK 5,289 all of which are incorporated by reference.

SUMMARY OF THE INVENTION

Directed to remedying the above-mentioned disadvantages of the prior art, an improved electrically-powered adjustable articulated bed is herein disclosed. The bed includes a foundation having a head section, which supports the head portion of an overlying mattress, and a generally separate body section, which supports the body portion of the mattress. The foundation is supported by and in a stationary frame. A first motor supported by the frame raises and lowers the foundation head section and thereby the mattress head portion. The mattress can be that disclosed in U.S. Pat. No. 4,234,981, for example.

The foundation body section has articulated foot (or lower leg), thigh, and seat (or central) sections, and a second motor moves the foot and thigh sections relative to one another so that the mattress body portion assumes the desired shape for the (lower half of the) user. Particularly, the seat section is fixed horizontal to the foundation frame, the thigh section is pivoted to the seat section and the foot section is pivoted with a hinge to the other end of the thigh section. The second motor when energized lifts this hinge through a torque tube assembly and a pivot arm operated by that assembly. The rear end of the foot section is pivotally connected by a foot support link to the frame. And thus as the rear end moves due to the hinge being lifted, the rear end follows a path of constant distance to the link-frame pivot point.

The first motor is operatively connected to the foundation head section such that when operated it moves the foundation head section simultaneously in three directions—it pivots the head end thereof up with a pivoting force, it moves the head section out the pivot axis with a vector force, and it moves the head section towards the head end of the frame with a reactive force. With these three superimposed movements, the head edge moves with a straight-line vertical movement, maintaining a constant distance from an adjacent parallel wall. In other words, the movement of the head section can be described as a "versed sine" movement. The user lying on the mattress thus does not move horizontally away from lamps, telephones and other adjacent objects. Another way to understand the movement that the user lying on the mattress experiences as the head end of the mattress is raised is the following: the user is pictured wearing sweat clothes and lying on a slick gymnasium floor; his shoulders are grabbed and pulled vertically straight up, he bends at the waist and his entire body including his feet are pulled towards the plane of this vertically straight-up motion.

The foundation head section moves a distance (of about seven inches) further away from the adjacent edge of the foundation body section as the first motor moves it. This results in reduced creasing at the juncture of these two surfaces of the corresponding top surface of the mattress supported on the sections. This, in turn, reduces if not eliminates the pinching action previously experienced wherein the buttocks of the user lying on the mattress were pinched by the creasing mattress (58) as the head of the mattress was raised by a conventional adjustable bed (50).

As the motor moves the head section towards the frame head end, it pulls the entire foundation assembly, including the body section and the mattress body portion thereon, relative to the frame and towards the wall. This moves the foot end of the foundation a little over twelve inches from a substantial overhang position (of about sixteen or seventeen inches) overhanging the foot support end (the rearmost frame end caster) to a position overhanging the support end by a small distance. There is a risk, albeit small, that the bed (which has an overall length of about eighty inches) could tip over should a severely obese person plop himself down or fall down on the very end of the foundation foot end when in the substantial overhang position. Thus, a support leg or floating bail is provided hanging down from the foot end to engage and drag along the floor or carpet rearward of the rear frame support legs.

The basic lower frame includes four corner posts or legs, casters fitted on each of the legs, a pair of lateral rail tubes and a pair of cross members. Mounted within this basic (rectangular) frame are four horizontal tubular glide rails, parallel to the lateral rail tubes and forming a trackway. The motorized foundation assembly (or the "pivotal glide" or the "upper carriage") is supported on this trackway such that it can transverse longitudinally on the trackway and within the lower frame. This longitudinal movement results when the foundation head (or back) section is inclined and declined.

Pivotal links connect to the head end of the frame at one link end and to brackets secured to the underneath of the head section at the other link end. Thus, as the head section is pivoted up, these (fixed length) links cause the motorized foundation assembly to transverse within the lower frame and the extreme head end of the mattress to move only in a fixed vertical plane. The first and second motors can be operated by a pendant-type or wireless controller placed on a night stand adjacent to the head end of the bed. The user has easy access to the controller due to the combined pivotal and tranverse movements of the head section of the bed. The multiconductor electrical pendant cord may have a small diameter especially if low voltages are used to activate switching of high voltages in a controller located under the bed. Infra-red or radio frequency types of controllers may be used when it is desired to eliminate the direct wiring and/or when the controller is to perform other functions such as switching the lights or operating television, radio or video cassette recorders. One or more massage motors can also be incorporated into this bed as would be apparent to those skilled in the art.

In other words, disclosed herein is an adjustable articulated bed including a bed foundation having a body member and a generally separate head member, a mattress supported on the foundation, an electrical motor coupled to the head member, and a support frame which supports the mattress, foundation and motor. The motor when operated pivots the head edge of the head member upwardly, moves the head member away from the body member along a roller-glide assembly, and together with the pivoting motion moves the entire foundation towards the head edge of the frame. Thereby, the head portion of the mattress does not slide with respect to the foundation head member and the head edges of the mattress and foundation travel up in a vertically straight line thereby remaining in constant close proximity to the wall at the head edge of the bed frame. Advantageously, the person lying on the bed experiences a similar movement; that is, his shoulders move in a straight vertical line. Thus, his head does not move horizontally out of position relative to lamps, radios, telephones or other nearby objects as the head portion of the mattress is moved between its flat and raised positions. Also, his buttocks are not pinched by a crease in the mattress as it folds up. The foundation body member has articulated foot, thigh and seat portions which are adjustable by another electrical motor to configure the upper surface of the body portion of the mattress as desired.

To provide improved packaging, transport, assembly and disassembly a preferred bed construction is manufactured in basically seven separate pieces. The foundation comprises a body component (including articulated foot, thigh and seat sections) and a separate head component; the (knock-down) lower frame comprises four separate components; and a separate modular power carriage component (including the first and second drive motors) for adjustably configuring the foundation (and thereby the mattress supported thereon) is provided. Each of the components can be packed and transported in its own separate box. Preferably three boxes will be used and the components will be packaged therein as follows: the foundation parts; the lower frame parts; and the carriage component. The largest of these boxes has dimensions of 60"×50"×10" and when packed weighs only ninety pounds, and the smallest of these boxes when packed weighs only thirty pounds. These boxes can thus be easily handled and carried by a single man. Although he may have to take the time to make a few trips from his delivery truck to the desired assembly location, the much greater expense of a second delivery man is not needed.

The seven bed components can be easily and readily assembled by the delivery man or the user without the need for any tools. The components are manually aligned and snap fit together. Using wedge-type connections the longitudinal and lateral rails, together with the corner posts, are fitted together to form the bed frame. A spring clip secures the rollers of the carriage for support on the bed frame and gliding movement on the longitudinal frame rails thereof. Hooks align foundation body and head portions relative to the carriage and spring clips secure them in place. The drag links, which pivotally interconnect the foundation head portion to the head cross rail of the frame, can be either assembled by using a spring pin connection to the cross rail or by using a spring clip to connect two drag link parts together at a central drag link location.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 14 is a fragmentary side elevational view of the head portion of the bed of FIG. 12 shown in a partially raised position;

FIG. 15 is an enlarged cross-sectional view taken on line 15—15 of FIG. 14;

FIG. 16 is a partial fragmentary view taken on line 16—16 of FIG. 15;

DETAILED DESCRIPTION OF PREFERRED EMBODIMENTS

Figure 4:
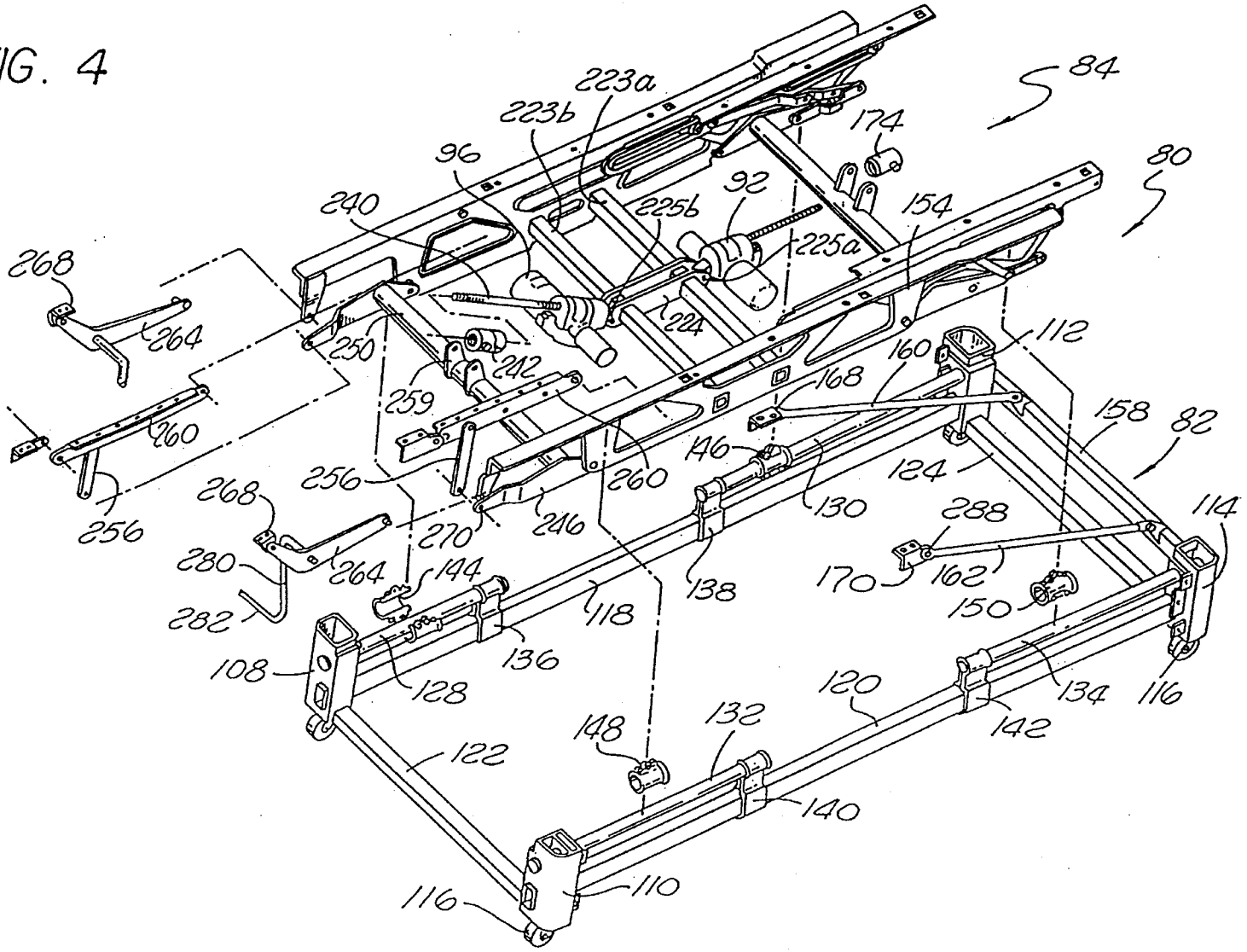
FIG. 4 is an exploded perspective view of the bed of FIG. 2.

Referring to the drawings, a preferred articulated adjustable bed embodiment of the present invention will now be described in detail. An articulated adjustable bed of the present invention is shown in the drawings generally at 80. Referring to FIG. 4 for example, bed 80 is seen to comprise a lower support frame shown generally at 82 and a motorized foundation assembly (or a "platform glide" or an "upper carriage") shown generally at 84 and positionable in the support frame. The foundation assembly 84 includes a two-part foundation at the top thereof. One part is a head foundation section or part 86 having a length of approximately 30.5 inches and the other part is a body foundation section or part 88 having a length of approximately 49.25 inches. The body foundation part 88 is articulated as will be described later and as is apparent from FIG. 11, for example. The foundation parts can be mattress foundation or box spring (either coil or "kinky" spring) types of foundations. The foundation parts 86, 88 can each be constructed, for example, of a plywood or chipboard base, a polyfoam layer glued to the plywood and a cover over them and filled with a fill material.

The foundation parts 86, 88 in turn support a mattress 90 such as is used on conventional prior art articulated beds and manufactured by Simmons, Sealy, and so forth. This mattress 90 can have hinges therein to hingedly couple the different parts or sections together. The mattress 90 need not be secured to the foundation parts 86, 88 but can simply rest on top of them. If desired, straps at the foot end mattress corners can be used.

The motorized foundation assembly 84 includes a first motor 92 which lowers and raises the foundation head section 86 and, as will be described later, pulls the entire motorized foundation assembly within the frame 82 and towards the head end 94 of the frame. A second motor 96 when operated controls the articulation of the foundation body section 88 and thereby the body portion 98 of the mattress 90 as can be seen by comparing the left halves of FIGS. 10 and 11. These motors 92, 96 can be operated by a remote control such as previously described.

Figure 1:
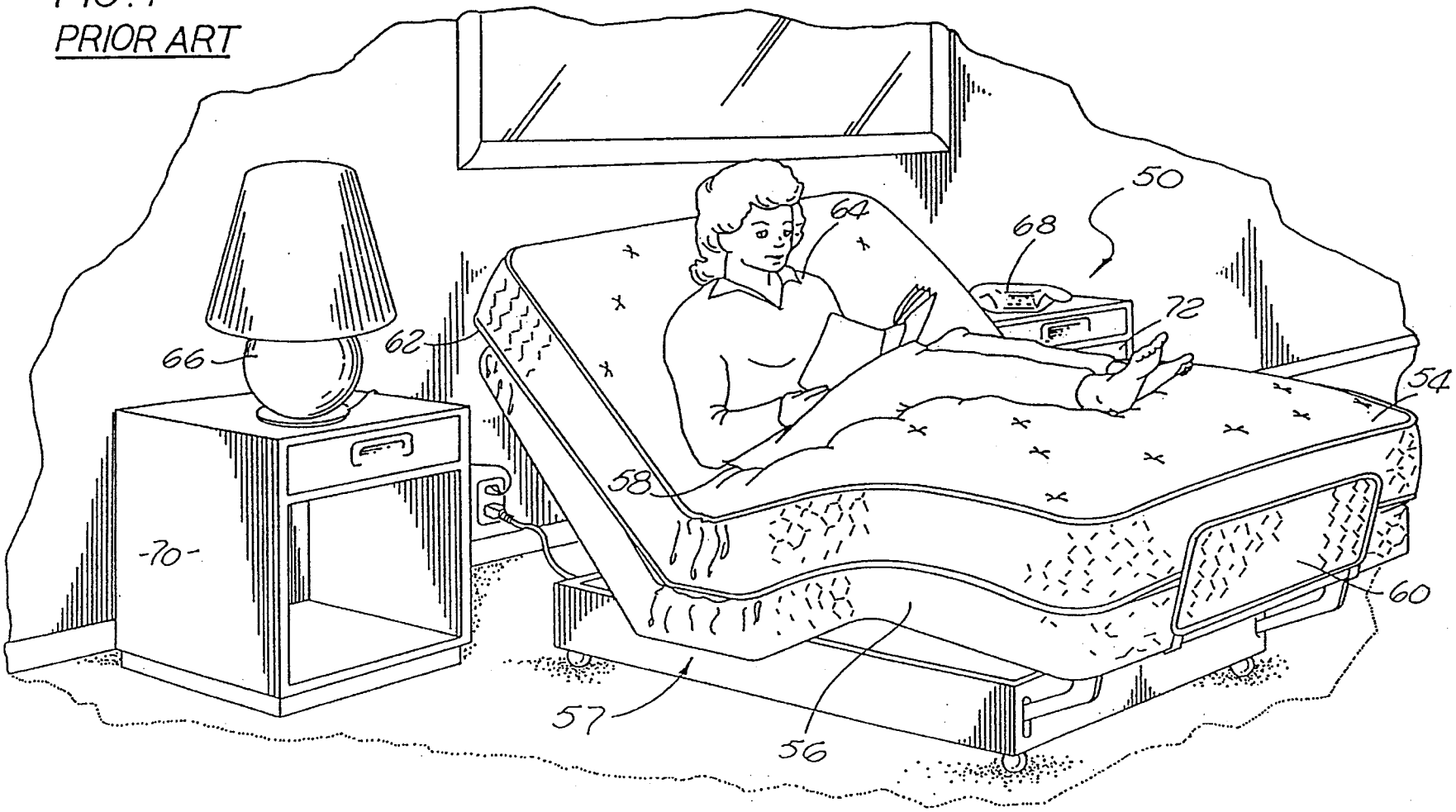
FIG. 1 PRIOR ART
FIG. 1 is a perspective view of an adjustable articulated bed of the prior art, shown in use (but without blankets and bed sheets for illustrative purposes)
Figure 2:
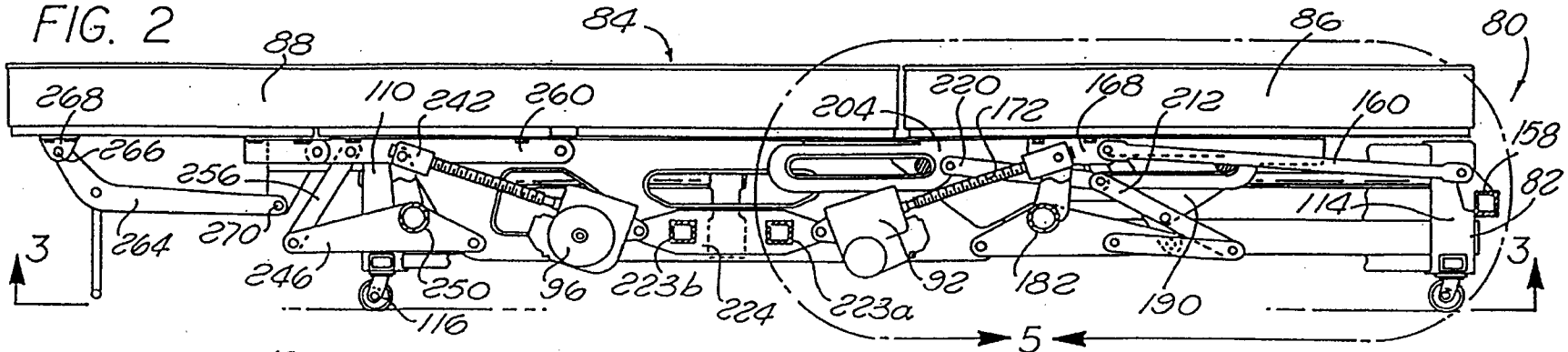
FIG. 2 is a side elevational view of an adjustable articulated bed of the present invention, shown without a mattress and in a flat orientation.
Figure 9:
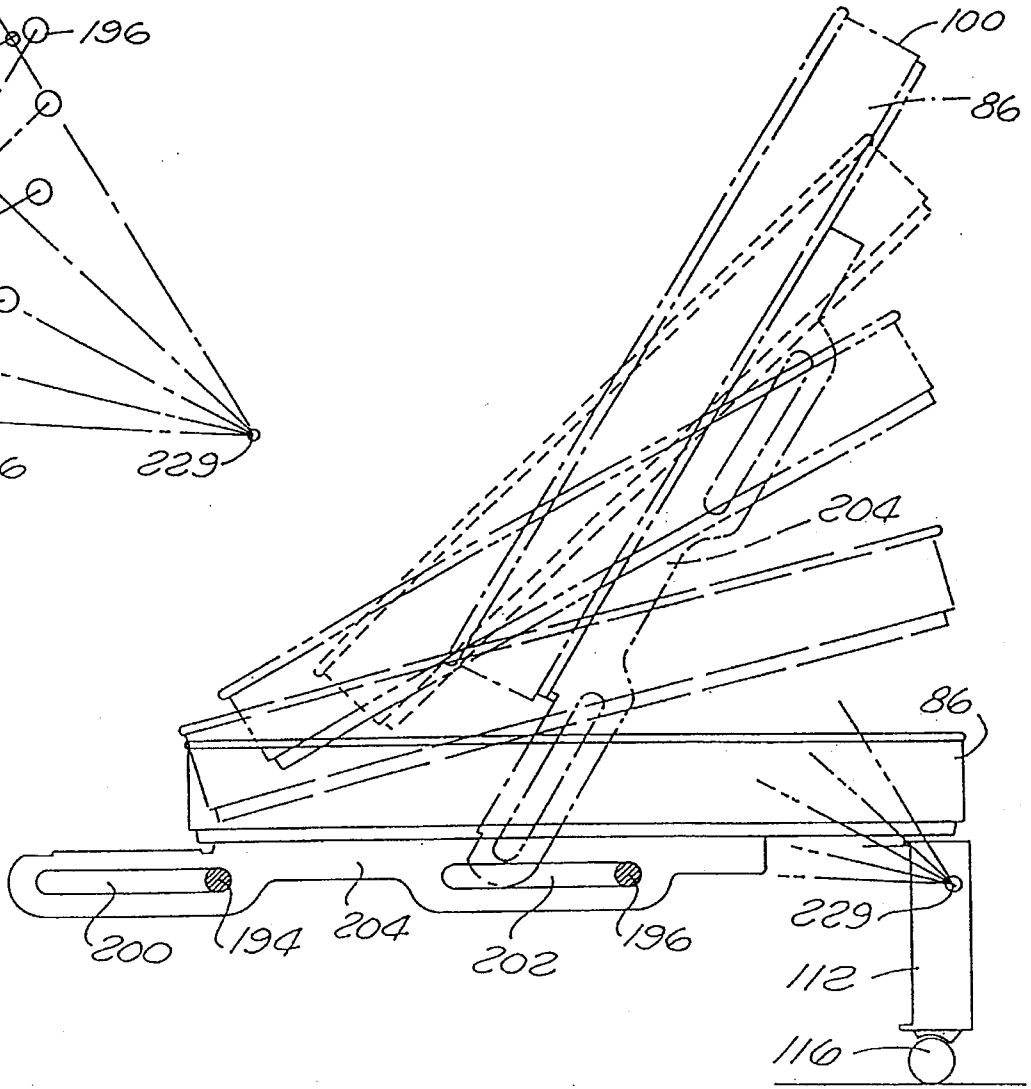
FIG. 9 is a schematic representation showing the movement of the head section between its horizontal and fully raised positions.

With the operation of the first motor 92 the foundation head section 86 is caused to have three simultaneous movements, as can be perhaps best understood by looking at FIG. 9. The first movement is the upward pivoting of the foundation head section 86 to a maximum of sixty degrees, the second is a vector motion of approximately seven inches out along the pivot axis and the third motion moves the foundation head section horizontally forward about twelve and five-eighths inches towards the end 94 of the frame 82, that is, towards an adjacent wall (see FIG. 1) at the head end of the frame. These three motions when combined result in the movement as shown by the dotted lines in FIGS. 9 and 10. This resulting movement causes the forwardmost edge 100 of the foundation head section 86 and thus the head edge 102 of mattress 90 to move vertically varying only by a horizontal inch in a straight line; that is, the head portion of the mattress moves with a "versed sine" motion. The head edges 100, 102 of the foundation head section 86 and of the mattress 90 remain aligned as can be seen in the upper right corners of FIGS. 10 and 11, and unlike the prior art as shown at 62 in FIG. 1. Additionally and referring to FIG. 10, the shoulders 104 of the user 106 lying on the mattress 90 remain in (substantially) the same vertical plane when in the lower flat position and when in the raised position as can be understood from FIG. 10. Lamps, phones, clocks, bed controls and other nearby objects (see FIG. 1) are still conveniently positioned and oriented for the user. He does not need to reach back behind him to access them.

Figure 10:
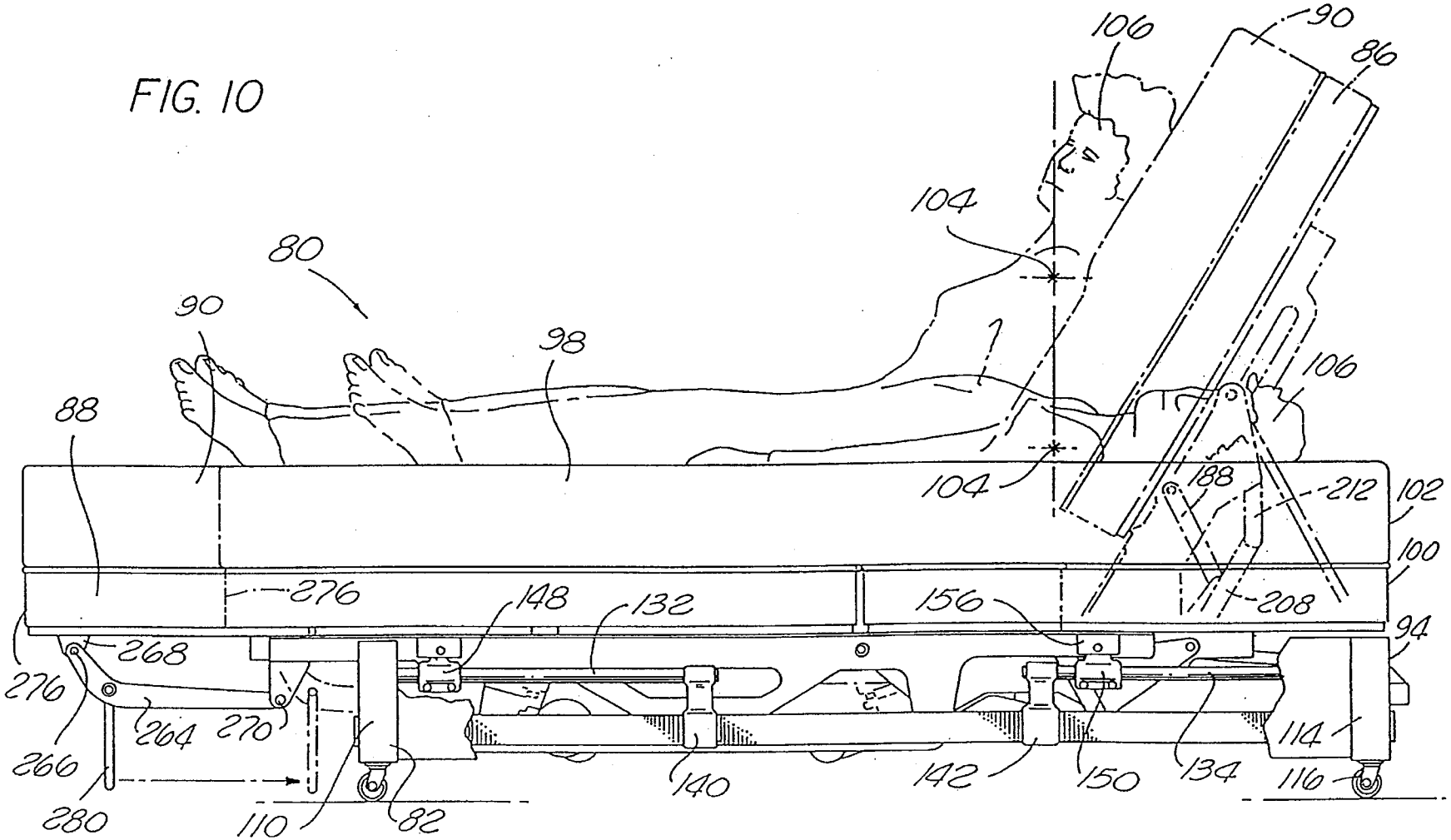
FIG. 10 is a view similar to that of FIG. 2, showing a mattress in position thereon, a person lying on the mattress and (in dotted lines) the head section of the bed in a fully pivoted position.

Referring to FIG. 4, frame 82 includes four corner posts 108, 110, 112, 114 with casters 116 fitted to the bottoms of each of them, snap fit into post bottom sockets. A pair of longitudinal rails 118, 120 and a pair of lateral rails 122, 124 connect the posts 108, 110, 112, 114 into a rectangular configuration. Four rail guide members 128, 130, 132, 134 are each connected at their ends to respective corner posts 108, 110, 112, 114 by passing (or floating) through post holes with a tenon and mortise fit. They extend inwardly and longitudinally above the side mils 122, 124 and are held at their inner ends by respective brackets 136, 138, 140, 142 secured above to the longitudinal rails by welding thereto. Four coupler sleeves (or clam shell bushings or linear bearings) 144, 146, 148, 150 encircle respective ones of these rail guide members 128, 130, 132, 134 and are secured to the frame 154 of the motorized foundation assembly 84 by connecting brackets 156, such as shown in FIG. 10, having a pin attachment and rocking capabilities to account for deflection. Thus, when the motor 92 is powered the motorized foundation assembly 84 slides longitudinally along the rail guide members 128, 130, 132, 134. The couplers alternatively can be constructed as upper and lower rollers, which can have curved engagement surfaces, instead of the bushings.

Figure 11:
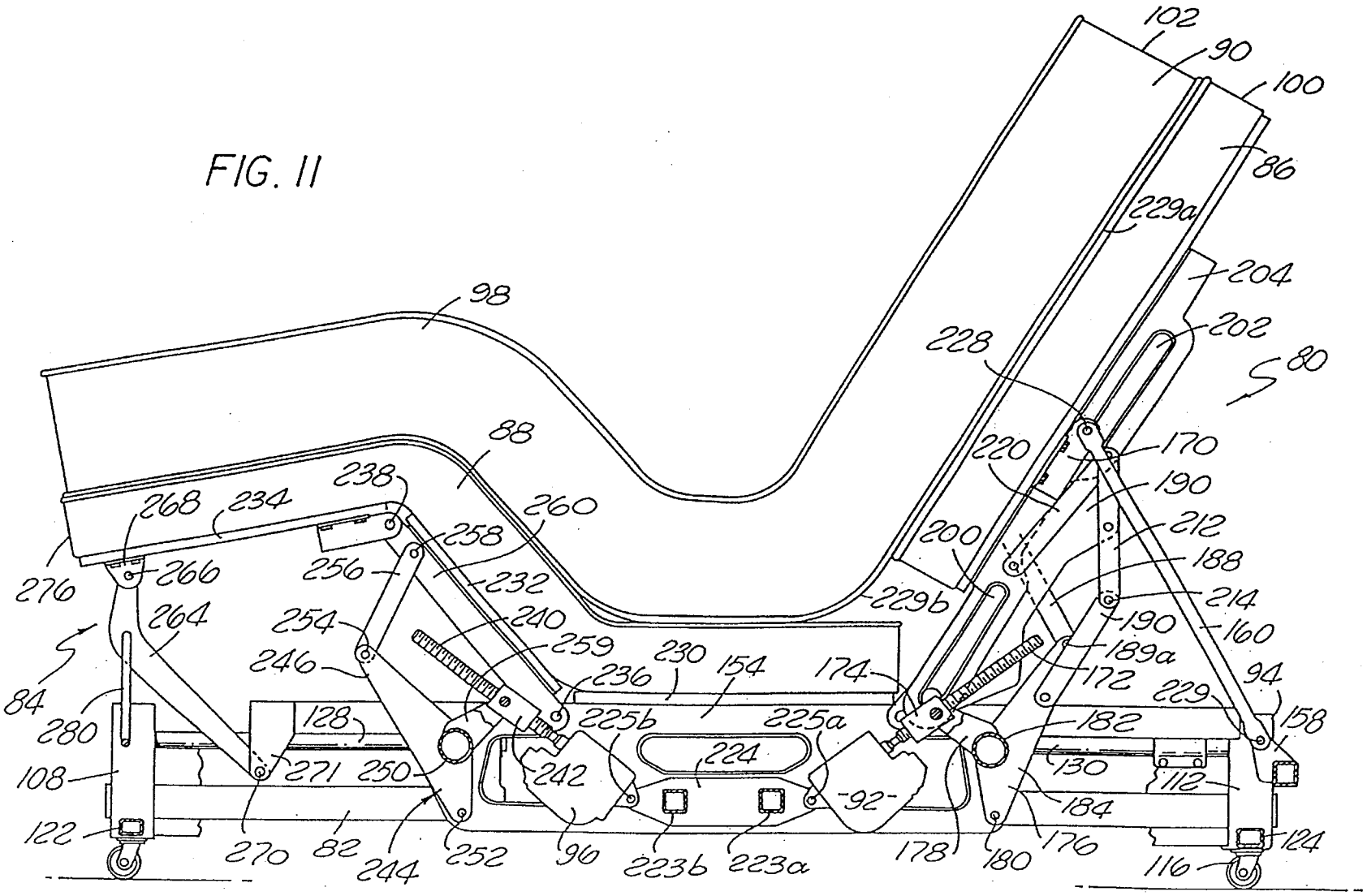
FIG. 11 is a view of the bed and mattress similar to that of FIG. 12, but without a person lying thereon and with the foot and thigh sections thereof in the fully elevated positions and the head portion in the fully pivoted position.

A lateral support tube 158 is secured to the two corner posts 112, 114 and extends between them at the head end 94 of the frame. Flattened tube drag links 160, 162 are pivotally secured by respective brackets 164, 166 at lower ends thereof to that tube 158. At their upper ends these two drag links 160, 162 are pivotally secured to respective brackets 168, 170 which are mounted to the bottom of the foundation head section 86. The drag links 160, 162 cause the entire motorized foundation assembly 84 to move longitudinally towards the head 94 of the frame 82 as the foundation head section 86 is lifted. Drag links 160, 162 push the bed with respect to the frame as the head section is lowered, and prevent the bed from being pulled back and forth. They keep the brackets 168, 170 at a fixed distance from the tube 158 at the head end 94 of the frame, as the head section is lifted and lowered. Springs can be provided on forward rail guide members 130, 134 to prevent locking when drag links 160, 162 are in their fully raised positions as shown in FIGS. 8 and 11.

Figure 5:
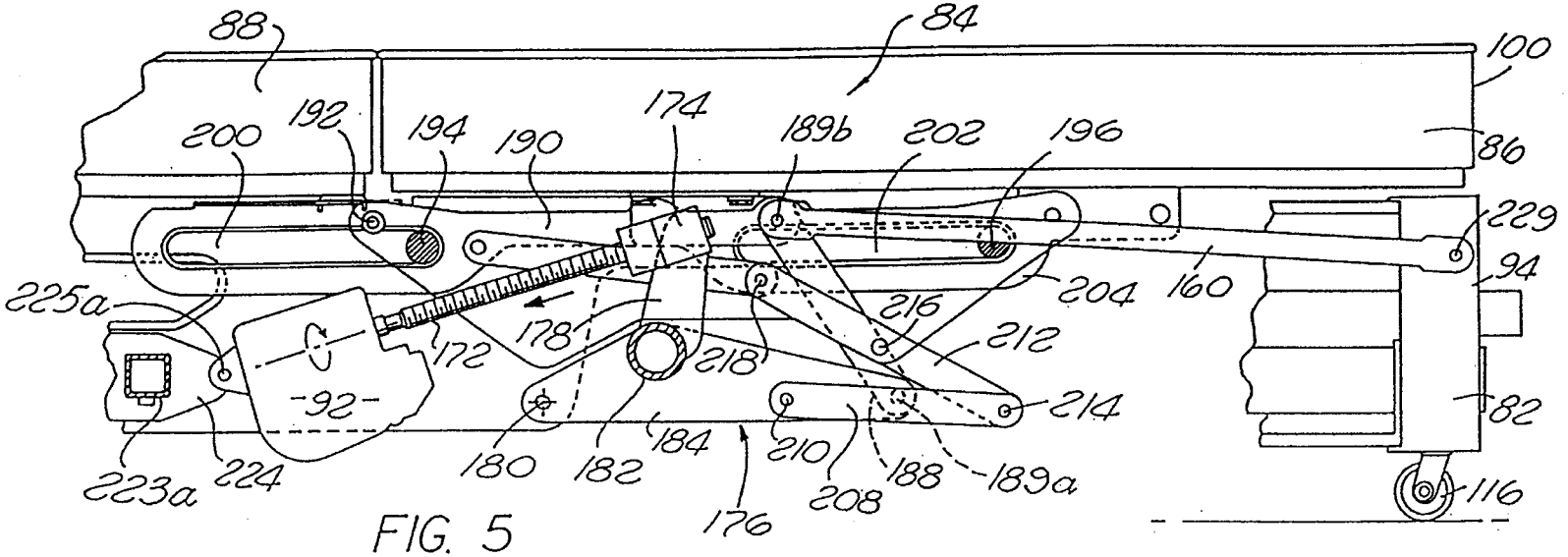
FIG. 5 is an enlarged view taken on circle 5 of FIG. 2.
Figure 6:
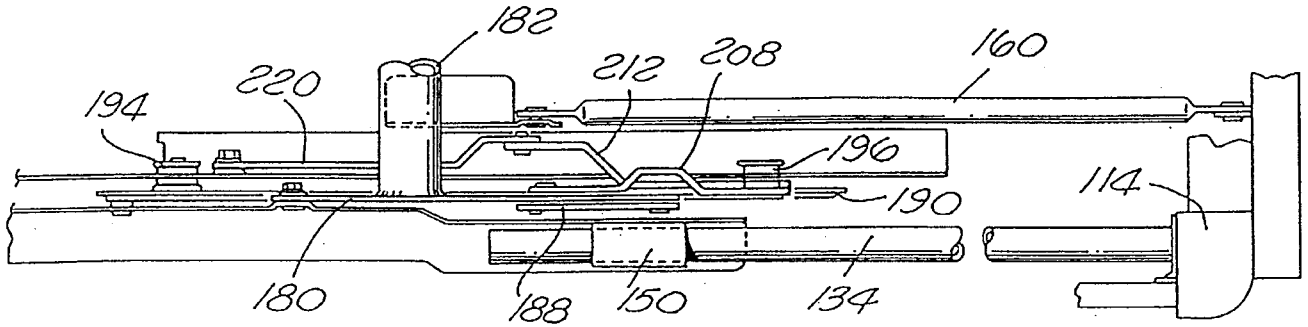
FIG. 6 is an enlarged view taken on circle 6 of FIG. 3.
Figure 7:
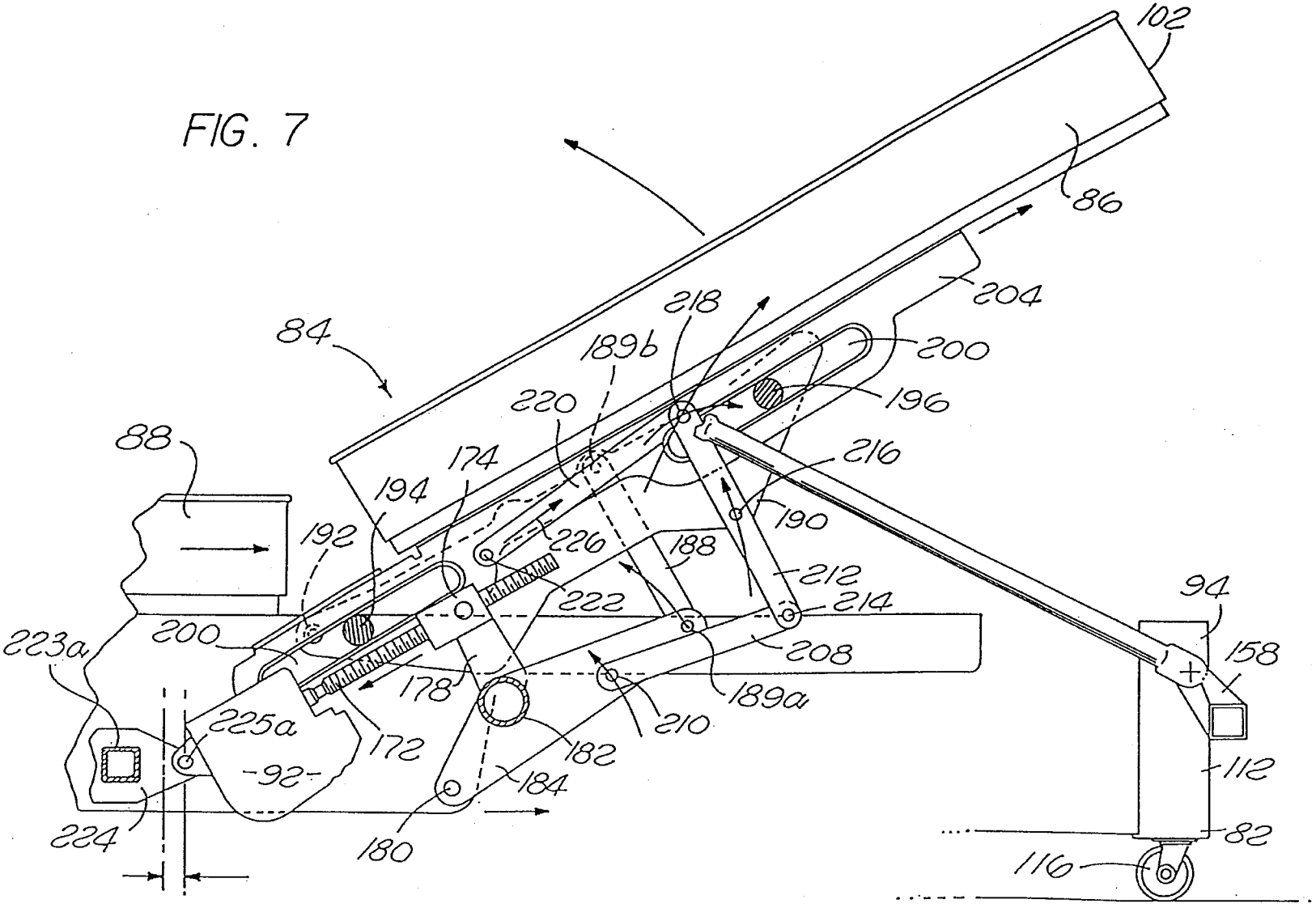
FIG. 7 is a view similar to FIG. 5, showing the head section in a partially raised position.
Figure 8:
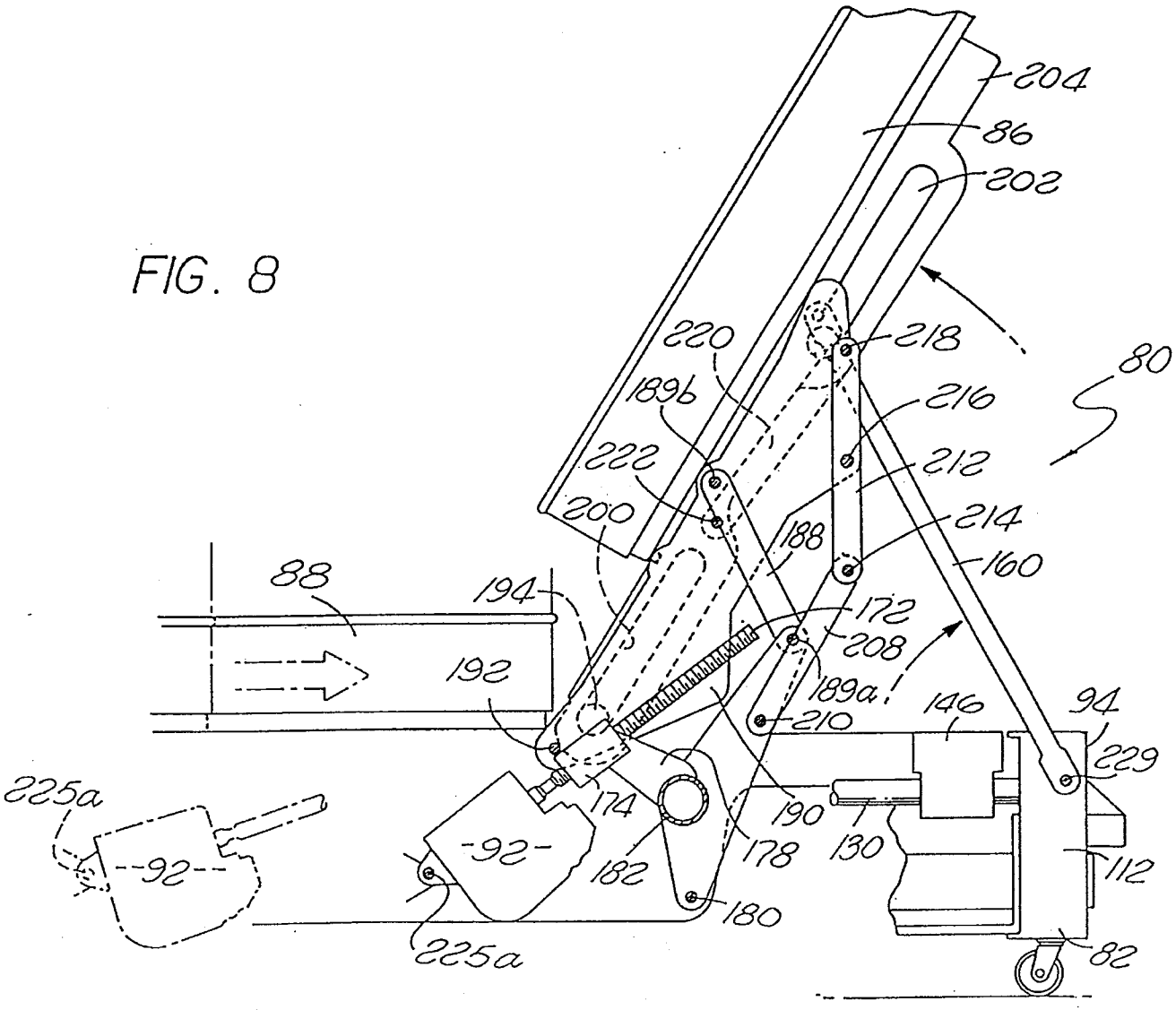
FIG. 8 is a view similar to FIG. 7, showing the head section in a fully raised position.

The pivotal or lifting movement of the foundation head section 86 can be understood, for example, by comparing FIGS. 5, 7 and 8 which show the raising of the head section and the linkage for doing such. Referring thereto it is seen that as the motor 92 operates through a drive gear the drive shaft 172 is rotated. This rotation causes a nut 174 secured with pivot pins on the shaft 172 to be moved along the shaft. A torque tube assembly shown generally at 176 is secured by a connector arm 178 to the nut 174, and as the nut is driven along the shaft 172 it causes the torque tube assembly to pivot about a pivot point 180 on the frame 154. The arm 178 is firmly secured to the cross bar or tube 182 of the torque tube assembly 176 using a "spanner wrench" type of securement together with welding. The torque tube assembly 176 includes a triangular bell crank 184 with one corner of the triangle corresponding to the pivot point 180, another corner including the transverse torque tube 182 to which the connector arm 178 is secured and a third corner. A lifting link 188 at one end thereof is pivotally secured at point **189*a* to that third corner and the other end of the link is pivotally secured at point 189*b* to a primary hinge 190. The primary hinge 190, in turn, is pivotally connected at end point 192 to the foundation frame 154. Thus, point 189*b* travels in an are about point 192 and point 189*a* travels in an arc about point 180 as motor 92** is operated.

Primary hinge 190 has a pair of spaced rollers 194, 196 extending out from it. These rollers 194, 196 ride in elongated slots 200, 202 formed in a secondary hinge 204, which is fixed to the underneath of the foundation head section 86. The rollers 194, 196 are a bit smaller diameter than their respective slots 200, 202 so they do not contact simultaneously the tops and bottoms of the slots. This reduces the possibility of the rollers 194, 196 binding up due to minor twisting or misalignments of the two hinges 190, 204.

A second link 208 is pivotally connected to an intermediate bell crank point 210 at one end thereof and at the other end thereof it is secured to a pendulum or rocker link 212 at point 214. The rocker link 212 is pivotally connected at its center 216 to the hinge 190 and at its opposite end 218 to another link 220, which is pivotally secured at its opposite end 222 to the secondary hinge 204.

A pair of tubular lateral support members **223*a*, 223*b* extend spaced and parallel across a central portion of the foundation frame 154. Each has a square cross section fitting into corresponding square apertures in the foundation frame 154. Mounted midway on the members 223***a*, 223*b* are a pair of motor mounting plates 224. The motors 92, 96 are pivotally mounted at opposite ends of the plates and on opposite sides of the members at pivot points 225*a*, 225*b*, respectively. Pivot points 225*a*, 225*b* provide pivot, thrust and anchor points for the respective motors 92, 96. This mounting and support of the motors is similar to the arrangement described in the previously-mentioned U.S. Pat. No. 4,407,030 patent. One important difference though is that two (spaced) support members 223*a*, 223*b*, instead of a single support member, are used. This provides for more user seat room on the bed and thereby less pinching.

The motor 92 thus turns a worm gear which engages a bull or spur gear which turns the shaft 172. Pivot screws cause the turning shaft 172 to move the nut 174 along the shaft. As the nut 174 travels down the shaft 172 and the torque tube assembly 176 is rotated via connector arm 178 about point 180, the lifting link 188 is similarly rotated as shown by the arrows in FIG. 7, for example, exerting a pivoting force through point 189*b* on the hinge 190. As the nut 174 is pulled down the shaft the motor 92 exerts a thrust or pulling force on frame 154 through pivot point 225*a*. The motor 92 also pivots about that point. The rocker link 212 is then pivoted in a clockwise direction, by link 208, pulling on link 220, thereby pulling the secondary hinge 204 with a vector force out the pivot axis. That is, as the rocker link 212 is rotated clockwise at point 216 which is attached to the primary hinge 190, the other end of the link is pivoted about a (free link pivot) point 218 which is attached to link 220. Thus, as link 212 rotates about pivot point 216 in a clockwise direction it pulls the link 220 in the direction shown by the arrow 226 in FIG. 7. Link 220 is attached to the secondary hinge 204.

Figure 9A:
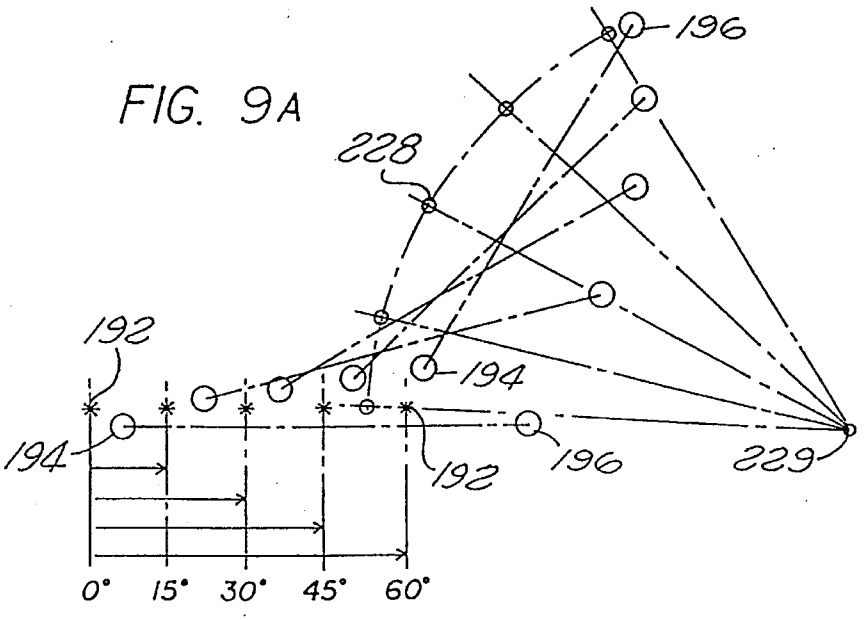
FIG. 9A is a view similar to FIG. 9, showing the rollers, the primary hinge pivot point and the support member pivot points in the 0, 15, 30, 45 and 60 degree pivot positions of the head section.

Thus, as the bell crank 184 is rotated, the pendulum or rocker link 212 is rotated clockwise away from the foot of the bed thereby pulling link 220 which pulls the secondary hinge 204. The secondary hinge 204, as it is being pulled towards the right as seen in the drawings, rides on the rollers 194, 196 within the slots 200, 204. See, for example, FIG. 9A. The secondary hinge 204 moves relative to the primary hinge 190 by this roller-slot relationship. As the primary hinge 190 is rotating about sixty degrees, it is being pulled along with the rest of the motorized frame assembly 84 on the sleeves (or bushings or linear bearings) 144, 146, 148, 150 due to the reactive force through support member(s) or link(s) 160 (and 162). The motions of the rollers 194, 196, the pivot point connection 192 of the primary hinge 190 to the assembly frame 154, the pivotal connection 228 of the drag links 164, 166 to the back of the frame head section 86 and the pivotal connections 229 of the members 164, 166 to the tube 158 are shown in FIG. 9A. The positions of each of these elements are shown therein at zero, fifteen, thirty, forty-five and sixty degree orientations of the head section 86. As can be seen, roller 194 moves in a small are and roller 196 moves in a larger arc.

The lifting force through lifting link 188, the vector force through link 220 and the reactive force through members 160, 162 thereby move the head section 86 with a "slithering" movement between its horizontal flat position and its pivotally raised position. The vector power or ejecting force is off of point 210. The forward edges 100, 102 of the mattress and head section travel vertically up and down.

The relationships and movements of the components were also chosen to minimize pinching of the user's buttocks in the crease of the mattress 90 as it is pivoted up. Particularly, and referring to FIG. 11, the top surface 229*a* of the head section 86 throughout its entire movement is always tangent to the curve 229*b* of the mattress 90. In other words, the top surface 229*a* moves a distance sufficient to maintain a tangency to the curve 229*b* being generated by the flexing of the mattress 90 at the buttocks or tail bone of the user.

As best seen in FIG. 11, the foundation body section 88 includes three articulated sections, namely, a seat or center section 230, a thigh section 232, and a lower leg or foot section 234. Each of these sections is articulated relative to the adjacent section or sections. The seat section 230 is fixed to the foundation frame 154, the thigh section 232 is pivotal relative to the seat section 230 about point 236, and the foot section 234 is pivotal about point 238 and movable relative to both of the sections. The mechanism for controllably moving or adjusting the thigh and/or foot sections 232, 234 is similar to that illustrated in the previously-mentioned U.S. Pat. No. 4,407,030 patent and reference is hereby again made to that patent. The mechanism is operated by the operation of the motor 96. The motor 96 has a gear train which drives a threaded shaft 240, which passes through a threaded, low friction bushing or nut 242, which is connected thereto with pivot screws. A torque tube assembly 244 is provided, similar to the one at the forward end of this bed. It includes a triangular plate or bell crank 246 secured at one corner to one end of the cross bar member 250 (another bell crank plate is secured at the other bar member end as seen in FIG. 4 for example), at a second corner pivotally to the foundation frame 154 at point 252, and at its third corner pivotally at point 254 to a lifter link or a pivot arm 256. Lifter link 256 is pivotally attached at its opposite end at point 258 to a longitudinal support member 260 secured to the thigh section 232.

Thus, as the motor 96 is energized and the nut 242 is caused to travel along the shaft 240 towards the motor, the bell crank 246 through connector arm 259 pivots about pivot point 252 in a clockwise direction. This in turn pivots the lifter link 256 upwardly against the support member or thigh hinge 260 thereby lifting the thigh section 232, as shown in FIG. 11. As the motor 96 pulls on the nut 242 it exerts a force on frame 154 through pivot point 225*b* and also pivots about that point.

A pair of J-shaped pivotal linkages or foot support links 264 are provided at the foot end of the bed. Link 264 is pivotally coupled at point 266 to a hinge 268 secured to the bottom of the foot section 234 of the foundation, and at its opposite end it is pivotally connected at point 270 to a bracket 271 which in turn is secured to the frame 154. Thus, as the thigh section 232 is lifted by the lifter link 256, the forward end of the foot section 234, which is articulated to the rear end of the thigh section 232, is lifted. The rearward or foot end of the foot section 234 is also lifted. And its movement is controlled by the foot support link 264, which maintains a constant distance between the two pivot ends of that link, that is, between the pivotal connection 270 to the frame bracket 271 which is secured to frame 154 and the lower pivotal connection 266 to the foot section.

As previously described, the entire motorized foundation assembly 84 moves longitudinally with respect to the lower foundation frame 82 as the foundation head section 86 is pivoted upwardly and downwardly. Thus, the foot edge or end 276 of the motorized foundation assembly moves as well and with respect to the rearmost posts or legs 108, 110 of the frame 82. Referring to FIG. 10, the rear edge 276 of the foundation assembly, when the head section 86 is in its fully raised position, is shown with dotted lines. And it extends beyond or overhangs the rear posts 108, 110. This overhang or underneath space is desirable to reduce the likelihood that people will accidently stub their toes or otherwise hit their feet against the rear posts 108, 110 or casters 116. When the head section 86 is lowered to its flat position, the foot edge 276 of the foundation extends even a further overhang distance out beyond the rear posts 108, 110. This distance is enough that in the unlikely event that a severely obese person would plop himself down or fall down on the overhang foundation portion the entire bed 80 could be tilted up and about the rear posts 108, 110 or rear casters 116. Accordingly, a rear leg or floating bail 280 extending down from the foot support links 264 is provided. As the foundation assembly 84 is moved in the frame 82, the lower end member 282 (see FIGS. 3 and 4) of this bail 280 simply rides or drags along the floor or carpet. In the event of this unlikely "toppling" force, the bail 280 contacts the floor thereby preventing tipping of the bed.

Figure 3:
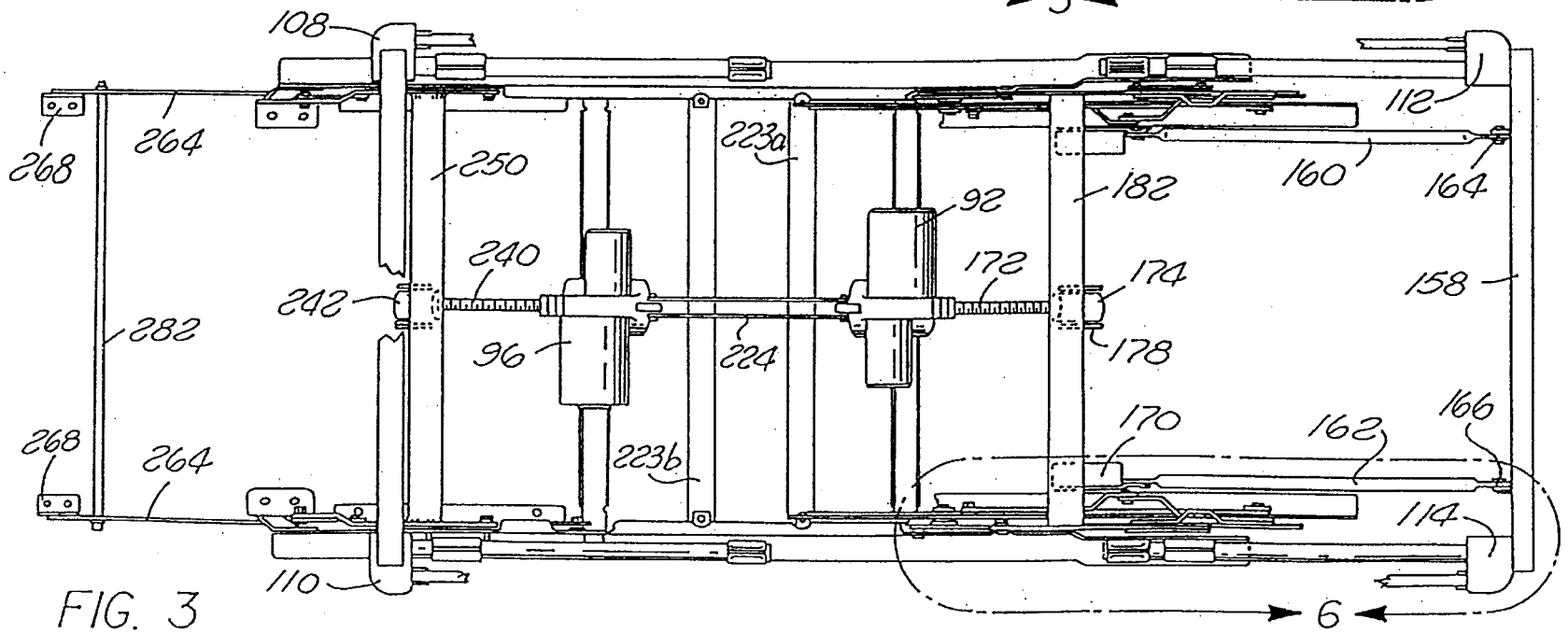
FIG. 3 is a bottom view taken on line 3—3 of FIG. 2 and with certain portions of the foundation omitted for illustrative purposes.

Bail 280 is formed as a U-shaped member as can be understood from FIG. 3, for example, and is pivotally attached to its opposite end to the foot support links 264. A slot or similar attachment can be provided to prevent pivoting or locking of the bail 280 from the "toppling" force. It is out of the way of the corner posts 108, 110 though when the foot section 234 is raised, as shown in FIG. 11. Instead of the bail 280 the foot support links 264 themselves can be reconfigured from their J-shapes to a V-shape and the point of the V can extend down a distance to perform the anti-toppling support function.

Figure 12:
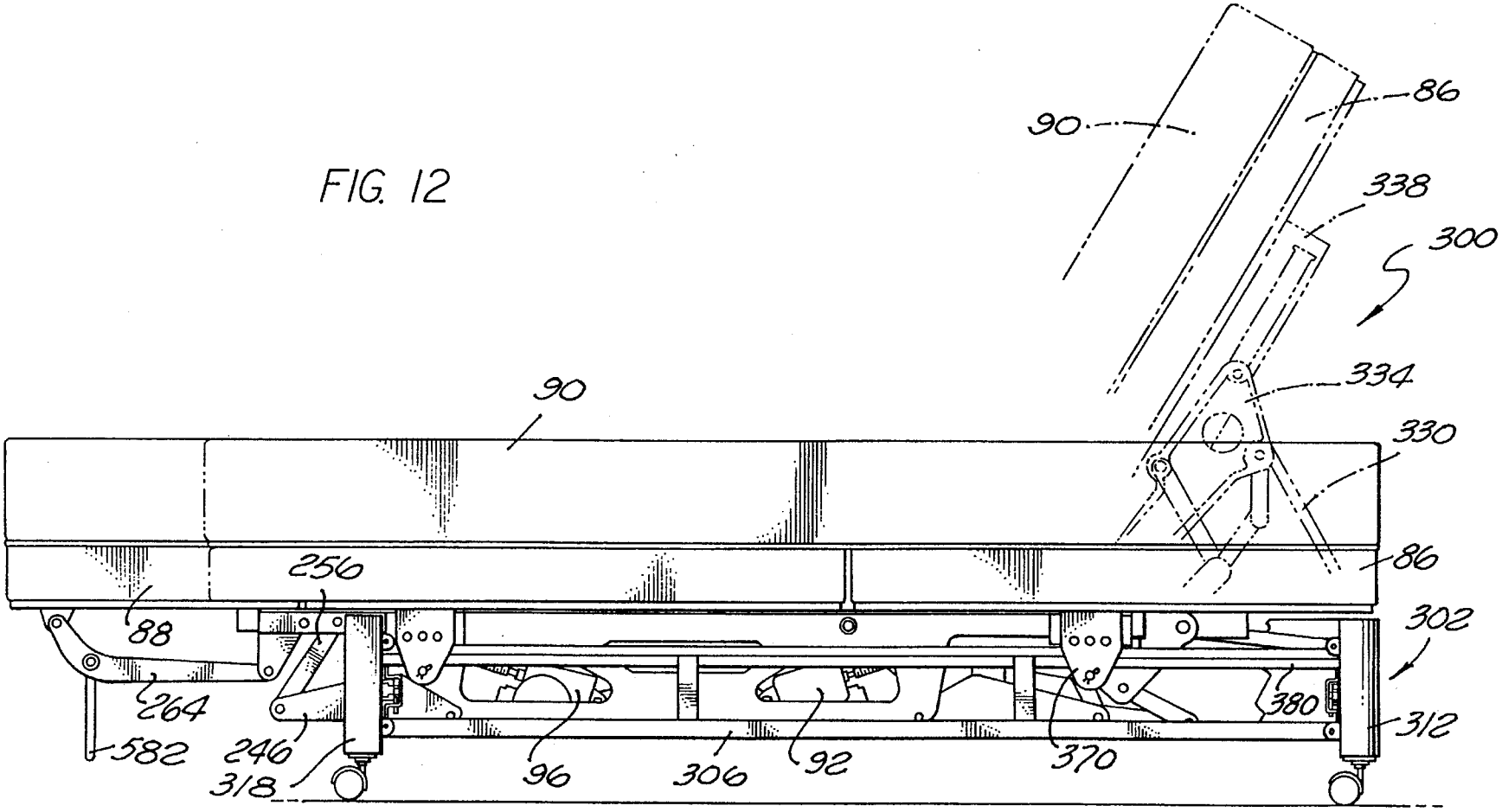
FIG. 12 is a side elevational view of an alternative (snap-together) articulated bed of the present invention, with the head section shown in phantom lines in a raised position.
Figure 13:
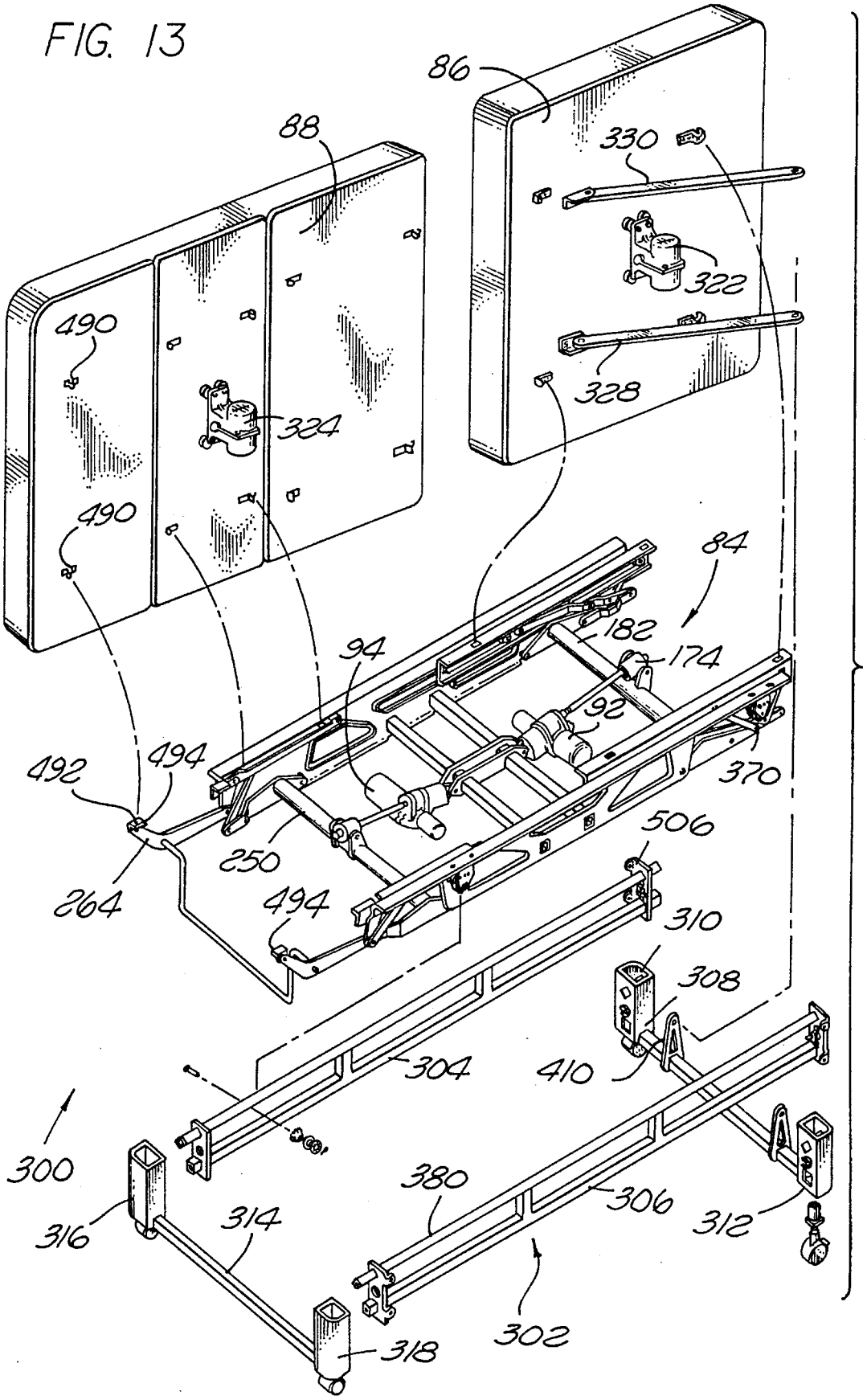
FIG. 13 is an exploded perspective view of the bed of FIG. 12.

Referring to FIGS. 12 and 13, an alternative adjustable articulated bed of the present invention is illustrated generally at 300. (The electrical boxes for the bed have been omitted for the sake of clarity.) Bed 300 is similar in operation to the previously-described bed 80 and thus many of the similar corresponding elements are accorded the same reference numerals. A primary difference between bed 300 and bed 80 is that bed 300 has been designed to have basically seven separate components, as illustrated in FIG. 13, each of which can be packed in a separate storage box. The components when unpacked can then be snap-fit or otherwise connected together, without the use of tools, to one another for easy assembly by the delivery man or even the ultimate user. By providing the bed 300 shipped in a number of individual boxes, and particularly three boxes though a greater number of boxes can be used if desired, it makes for easier transport of the bed to the user. That is, it is easier than transporting it in one very large box requiring at least two delivery men and being very heavy and awkward to negotiate it up numerous flights of steps or through winding narrow passageways. A number of other differences or improvements and alternative designs of various features of the 80 are also provided in bed 300 of FIGS. 12 and 13 as illustrated in subsequent figures and described below.

Referring to FIG. 13, bed 300 is seen to comprise a lower support frame shown generally at 302, a motorized assembly (or a "platform glide" or an "upper carriage") 84 and a foundation assembly for supporting a mattress 90. The frame 302 in turn includes a pair of side rail assemblies 304, 306, a head rail assembly 308 with corner posts 310, 312, and a foot rail assembly 314 with corner posts 316, 318. The foundation assembly includes a foundation head section 86 and a separate foundation body section 88. The foundation body section 88 is articulated into three lateral parts, similar to bed 300. Mounted beneath and to the foundation head section 86 is a first vibration motor 322, and a second vibration motor 324 is mounted underneath and to the foundation body section 88. An example of a preferred vibration or massage motor 322, 324 is the Jakel J-2385260 motor. A pair of drag links 328, 330 interconnects the foundation head section 86 to the frame head rail assembly and provides the functions as previously described for the drag links 160, 162.

Similar to bed 80 when the first motor 92 is actuated, it causes the foundation head section 86 to be pivoted and lifted using the three forces as previously described. An example of motor 92 is the Fascal 0008 motor. Bed 300 is illustrated in its fully raised position by the dotted lines of FIG. 12 and in a partially raised position in FIG. 14. As the foundation head section 86 is being raised or lowered, a portion of the primary hinge 334 slides in and with respect to the I-shaped elongated slot 336 of the secondary hinge 338. In bed 80, this motion includes rollers 194, 196 of the primary hinge 190 riding in the elongated slots 200, 202 of the secondary hinge 204. Although the rollers 194, 196 work well, they may be subject to vibration or rattle motions. Accordingly, bed 300 uses a square bushing 342 instead of the rollers, 194, 196, as is best shown in FIGS. 15 and 16. It is seen in those drawings that the square bushing 342 is held in the elongated slot 336 on the rearward side thereof by a round flat plate 346 which is directly adjacent to the ends of the inwardly-turned flanges 350 of the secondary hinge 338. The flat plate 346 has a central opening 352 through which a retaining pin 354 passes, and the end of the retaining pin is then received within a cup portion 356 of the circular plate. The pin head 358 is on the outside of the primary hinge 334. The curved portion 359 (FIG. 15) of primary hinge 334 is provided for structural strength. The square bushing 342 is blocked from passing rearwardly through the secondary hinge 338 by a forward flange 360. The pin 354 passes through an opening in the primary hinge 334, and the pin head 358 keeps the pin from passing rearwardly through that opening. The square bushing 342, as best shown in FIG. 16, includes a flexible finger 366 along its bottom surface to help prevent any rattling of the bushing within the slot 336.

When the motor 92 of bed 80 is powered, the foundation assembly 84 slides longitudinally along the rail guide members 128, 130, 132, 134, using coupler sleeves 144, 146, 148, 150 which encircle respective ones of the rail guide members. That is, to assist the motorized foundation assembly to traverse along the horizontal plane, bed 80 includes bushings circumventing round tubular frame members. These round bushings, however, can have a certain tendency to bind. Also, effort is required to remove the main frame from the side frames, entailing removing six screws and taking all the bushings and bearings apart.

Figure 17:
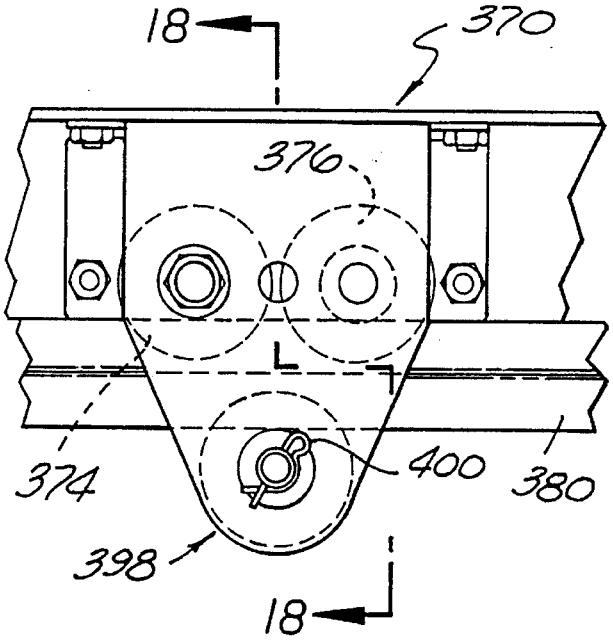
FIG. 17 is an enlarged elevational view of the roller glide assembly of the bed of FIG. 12.
Figure 18:
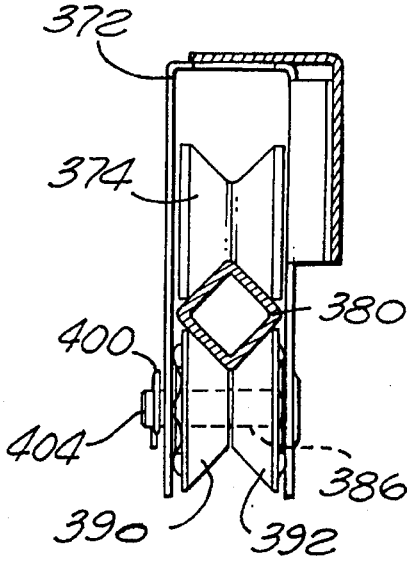
FIG. 18 is a cross-sectional view taken on line 18—18 of FIG. 17.
Figure 19:
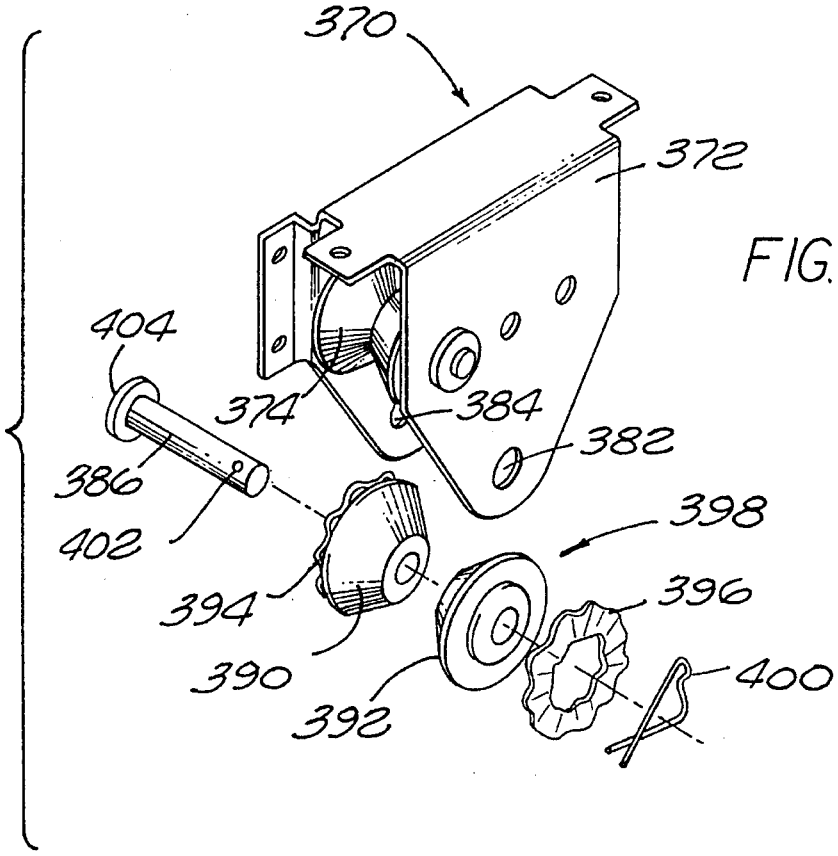
FIG. 19 is an exploded perspective view of the roller glide assembly of FIGS. 17 and 18.

Accordingly, an improved guide system is provided for bed 300, and this guide system or roller assembly is best shown generally at 370 in FIGS. 17–19. It includes a triangular-type U-shaped hanger bracket 372 secured in place by bolts or the like passing through openings in mounting tabs. Bracket 372 carries a pair of V-shaped rollers 374, 376 which roll along the diamond-shaped guide rail 380 (or 128, 136, 132, 134) of the frame. The diamond-shaped guide rail 380 is simply a square tube that has been rotated forty-five degrees. A pair of aligned through-openings 382, 384 at the bottom of the bracket 372 are provided for receiving a retainer pin 386 therethrough. The pin 386 passes through the brackets underneath the diamond-shaped rail 386 and through a pair of truncated rollers 390, 392 positionable one on either side of the diamond-shaped rail 380 and with a pair of wavy spring washers 394, 396 on the outsides thereof, to thereby form a lower roller 398. With the pin 386 through the washers 394, 396, rollers 390, 392 and both bracket openings 382, 384, a cotter pin 400 is secured through an opening 402 in the end of the pin. The retainer pin 386 at its other end has a retainer head 404. To disassemble the bed 300, each of the (four) cotter pins 400 is pulled out of its respective roller guide assembly 370. The pins 400 are pulled out to disassemble the bottom rollers 398 and then the entire top portion of bed 300 will lift off the side frames. The only other structures holding the carriage 84 or more specifically the foundation head section 86 to the frame 302 are the two long pivot arms or drag links 328, 330.

Figure 20:
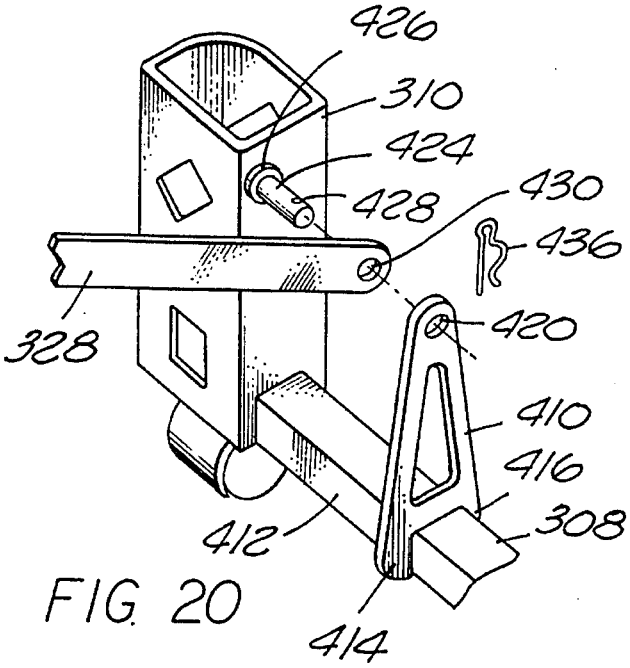
FIG. 20 is an enlarged partially-exploded view taken generally on circle 20 of FIG. 14.

These two drag links 328, 330 are released or disassembled with a similar type of snap-fit or pin-type arrangement, as is best shown in FIG. 20. In the embodiment of FIG. 20, an A-shaped mounting bracket 410 is welded to the cross rail member 412 with its legs 414, 416 straddling the rail. A hole 420 passes through the apex of the A-shaped bracket 410, and the A-shaped bracket has a height sufficient to position the hole at the desired location of the lower pivotal axis of the drag link 328. A retainer pin 424 having a retainer head 426 at one end and a cotter pin receiving opening 428 at the other is then passed through both the through-opening 430 at the lower end of the drag link 328 and the hole 420 at the top of the A-shaped bracket 410. The pin 424 is retained in place to pivotally secure the drag link 328 to the A-shaped bracket 410 by the retainer head 426 at one end and at the other end by a cotter pin 436 fitted through the opening 428 of the retainer pin. To disassemble the drag link 328 from the frame, the cotter pin 463 is squeezed or otherwise manipulated and then removed from the opening 428 in the retainer pin 424. Thereby when released, the drag link 328 is pivotally secured to the bed 300 only at its upper end to the foundation head section 86.

Figure 21:
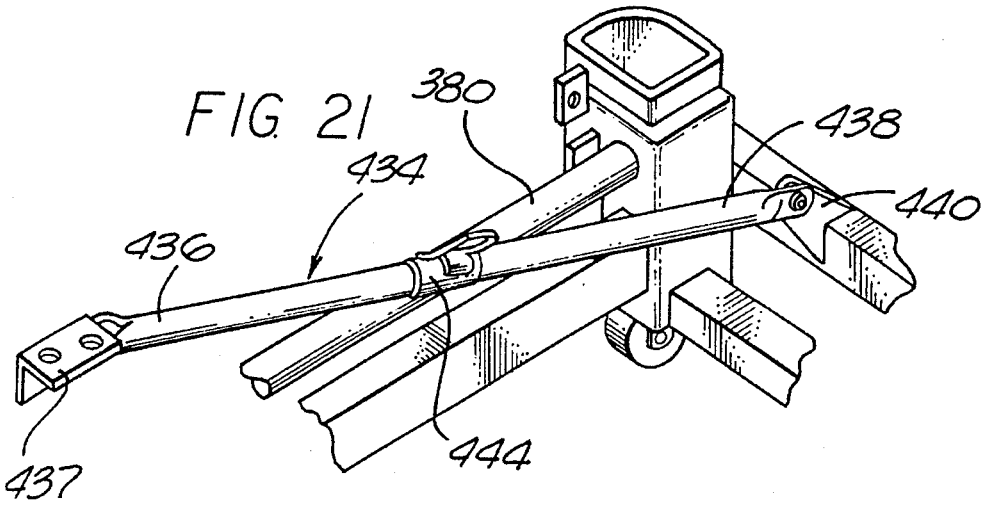
FIG. 21 is a perspective view of a head corner of the frame of FIG. 13 showing an alternative drag link arrangement.
Figure 22:
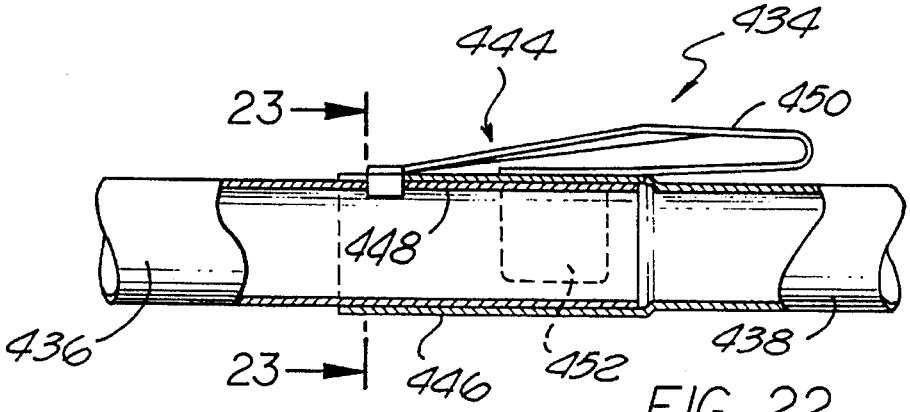
FIG. 22 is an enlarged, partially sectional view of the central portion of the drag link of FIG. 21.
Figure 23:
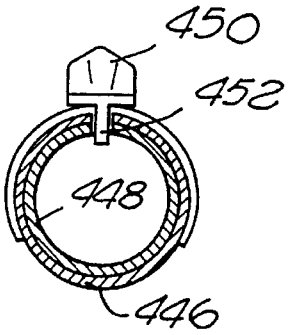
FIG. 23 is a cross-sectional view taken on line 23—23 of FIG. 22.

Another drag link embodiment is shown in FIGS. 21–23 generally at 434. Instead of connecting and disconnecting this drag link 434 for assembly and disassembly directly to the bed frame, the drag link is formed in two parts. The upper round tubular part 436 is pivotally secured to the foundation head section 86 via a bracket 437 and the lower round tubular part 438 is pivotally secured to the frame via a tab 440. And both parts then can be releasably coupled together at the central portion of the elongated long drag link 434 thereby formed, by releasable coupling means best shown in FIGS. 22 and 23 generally at 444. It is seen there that the lower drag link part 428 has an enlarged head sleeve 446 into which the lower end 448 (FIG. 22) of the upper drag link part 436 is received. And when received therein, slots in the drag link parts 438, 436 align and a spring clip 450 can be inserted into the aligned slots to secure the two parts together, to prevent movement in both directions. That is, the lower end 448 of the upper drag link part 436 slides inside of and into the upper end 446 of the lower drag link part 434 and then they are locked into place with a clip 450. The clip 450 extends around the circumference of one of the tubes and a spring arm or tab 452 locates into the aligned slots through both of the tubes. To release the two parts 434, 436 one need only press down on the spring portion of the clip 450 which then lifts the tab 452 out of the two slots. The upper drag link part 436 can then be slid out from inside of the lower drag link part 434 to pull the two parts apart. Similar arrangements described below for snap-fit securing the foundation head section 86 relative to the carriage 84 and the foundation body section 86 relative to the carriage are provided.

Figure 24:
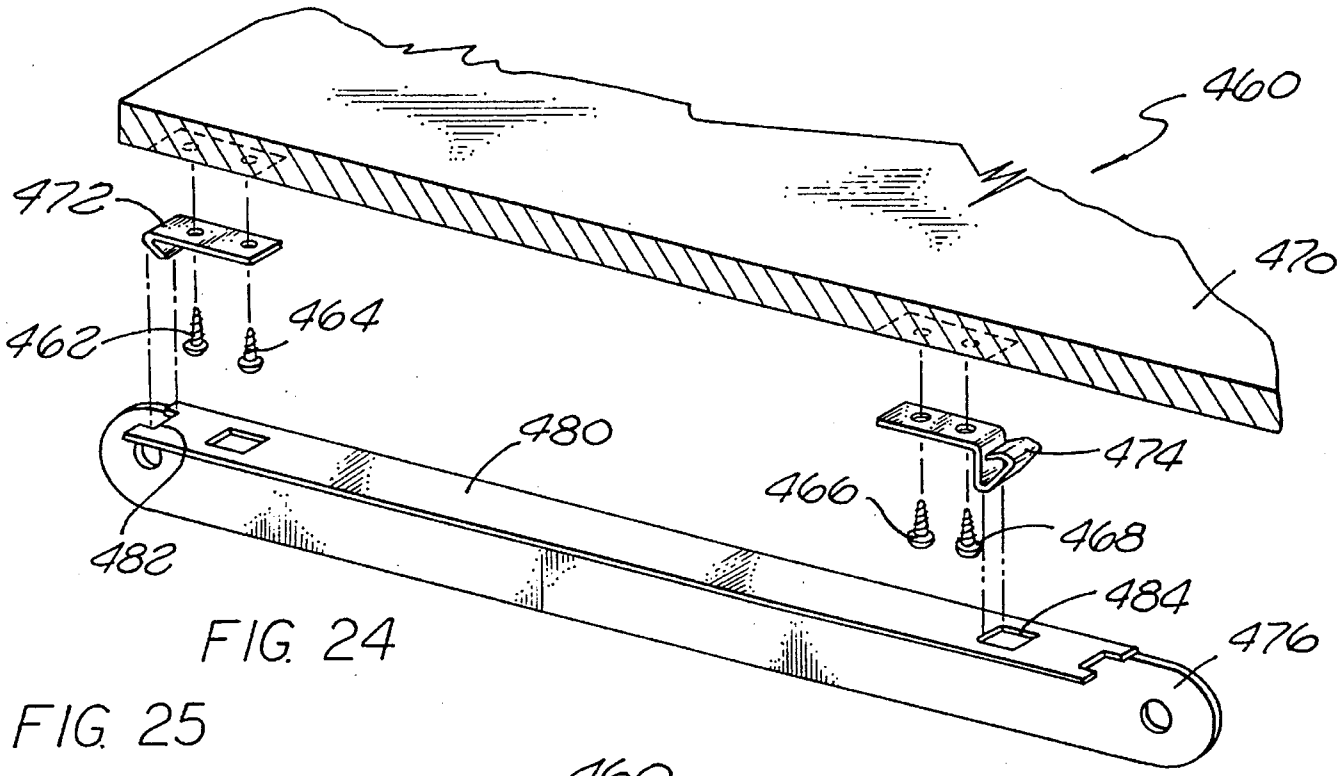
FIG. 24 is an enlarged exploded perspective view showing the mounting of one of the mattress foundation members to one of the hinge components of the carriage unit of the bed of FIG. 13.
Figure 25:
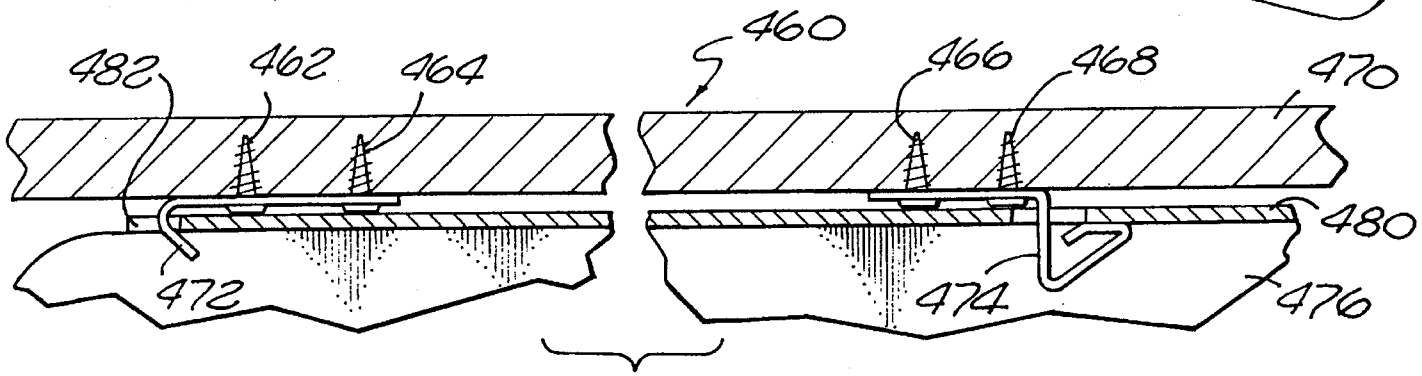
FIG. 25 is an enlarged, fragmentary cross-sectional view of the mounting arrangement of FIG. 24.

The systems for releasably securing the foundation head and body sections 84, 86 to the carriage 84 are similar, and thus only one of the four attachment systems is illustrated in FIGS. 24 and 25 generally at 460, but all four are shown in FIG. 13. It is seen there that screwed with screws 462, 464, 466, 468 to the bottom of the foundation (chip or plywood) board(s) 470 of the head or body sections 84, 86 are a rearward hook 472 and a forward spring clip 474. A corresponding elongated angled bracket arm 476 is provided as part of the motorized carriage 84. It is angled to provide a flat top surface 480. At the rear of this surface is a cut-out slot 482 and at the forward end on the top is a square through-hole 484. Thus, to secure the foundation or more particularly the foundation board 470 thereof to the motorized carriage 84, the hook 472 is fitted into the slot 482 and the clip 474 is press-fit down into the square hole 484 and when compressed and passed through, it springs open, as shown in the right half of FIG. 25, to secure the foundation board 470 to the motorized carriage 84. To release this clip 474 it is simply squeezed and manipulated so that it passes back up through the opening 484. Then the hook 472 is released from the slot 482.

Referring to FIG. 13, a spring clip 490 (or rather a pair of clips) is mounted at the foot end of the foundation body section 86. Spring clip 490 is configured to fit into a corresponding opening 492 at the top of a tab 494 pivotally connected to the rearward end of foot support link 264. A plate with a pair of pins (not shown) can also be mounted to the foundation body section adjacent the spring clip and corresponding pin securing openings (not shown) provided on the tab. The pins would help absorb the shearing forces imposed on the spring clip. A second pair of spring clips 496 (as best depicted in FIG. 13) are also provided on the foot section (234). They are positioned to releasably snap into corresponding openings 497 in tabs 498 (which are formed on the same members through which pivotal axis 238 passes as can be understood from FIG. 11).

Figure 26:
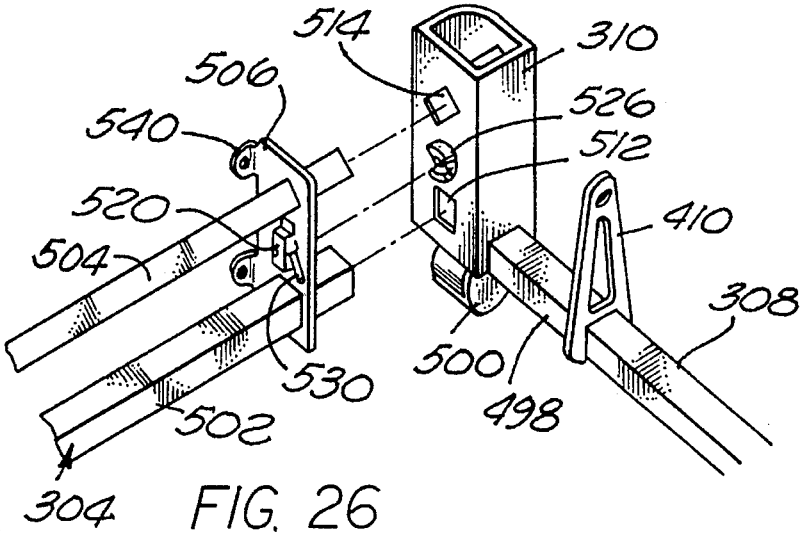
FIG. 26 is an enlarged perspective view showing a mounting of the side rails to a head corner post of the frame of FIG. 13.
Figure 28:
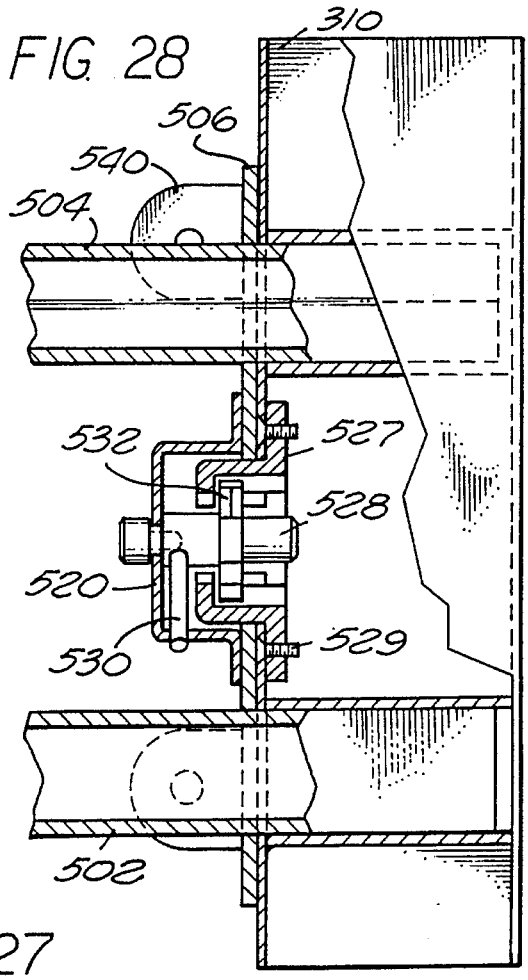
FIG. 28 is a side elevational view of the camlock of FIG. 27.
Figure 29:
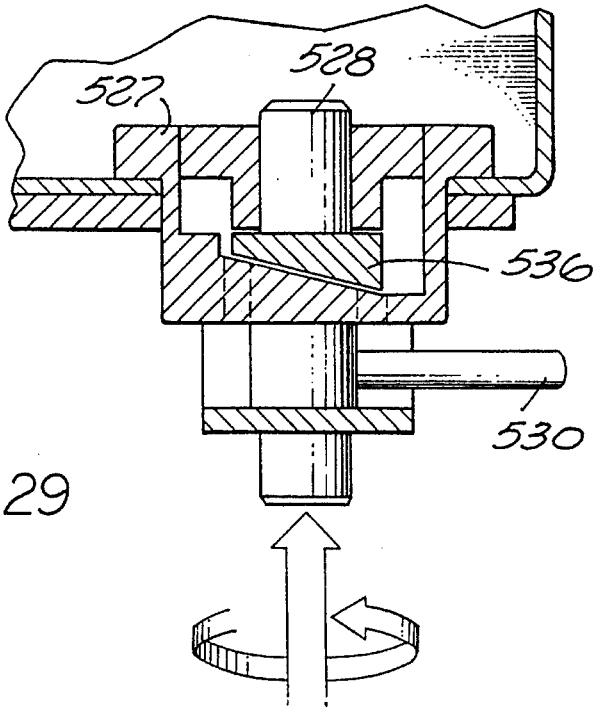
FIG. 29 is an enlarged view taken on line 29—29 of FIG. 27.

A number of ways of providing a bed frame which can be assembled and disassembled without using any tools are illustrated in the drawings. A preferred embodiment is shown in FIGS. 26–29. FIG. 26 shows one of the four frame corners—the left front corner, and a similar construction is provided for the other three corners of the bed frame, as can be understood from FIG. 13. The front cross rail member 498 (or 308) is permanently affixed to the left front support post 310 into which a suitable caster 500 is fitted into its bottom surface. The left longitudinal rail assembly 304 includes a square bottom tubular rail 502 and a diamond-shaped top rail 504 (or 380) along which the roller glide assembly 370 rolls. They are secured together with a flat plate 506 having square and diamond openings through which the two rails pass. Corresponding square and diamond-shaped openings 512, 514 in the rearward face of the support post 310 are provided into which the two rails 502, 504, respectively, are fitted. When fitted therein the male portion 520 of a camlock mounted to the connector plate 506 fits into the female portion 526 of the camlock on the support post 310. Shown in FIG. 28 are the stator 527, the rotor 528, and the connector screws 529. The lever or handle 530 on the male portion 520 can then be rotated to effect a camlocking action, which is better understood with reference to FIGS. 27–29. Two butterfly-shaped wedge members 532 are provided on the male portion of rotor 528. When the turning handle or lever 530 is turned, the wedge members 532 wedge up against corresponding surfaces 536 on female portion 526, thereby exerting a camming effect and securing the male and female portions 520, 526 together, with a window-latch type of action. "Left" and "right" acting camlocks would preferably be provided for the bed frame. The two tabs 539 with holes, as shown in FIG. 28 for example, are provided to secure a front cover (not shown) to the frame if desired.

Figure 30:
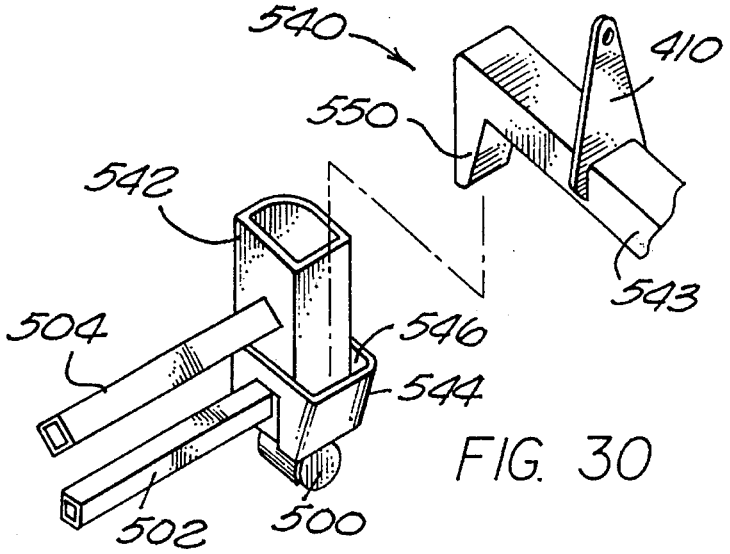
FIG. 30 is a view similar to FIG. 26 of a first alternative frame of the bed of FIG. 12 for example.

An alternative bed frame construction is illustrated in FIG. 30 generally at 540, wherein the diamond-shaped and square longitudinal members 504, 502 are shown permanently fixed to the support post(s) 542 and the front (and rear) cross member(s) 543 are separable from the support posts. A snap-fit or wedging arrangement releasably couples the cross member 543 at both ends thereof to the support post 542. Particularly, a cuff 544 is provided at the bottom of the support post 542 defining a tapered cup 546. At the end of the cross rail member 498 is a downwardly extending wedge member 550 which then fits securely into the cup 546 with a secure but releasable wedge fit.

Figure 31:
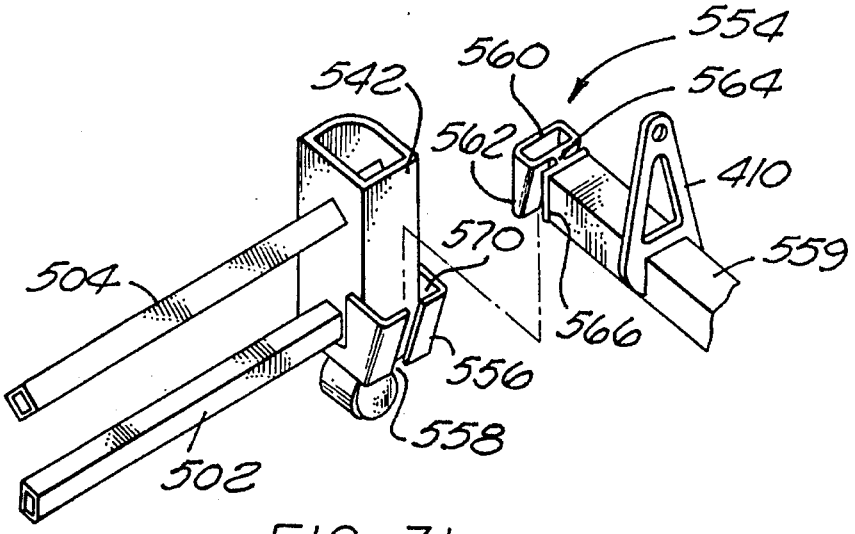
FIG. 31 illustrates a variation of the frame of FIG. 30.
Figure 27:
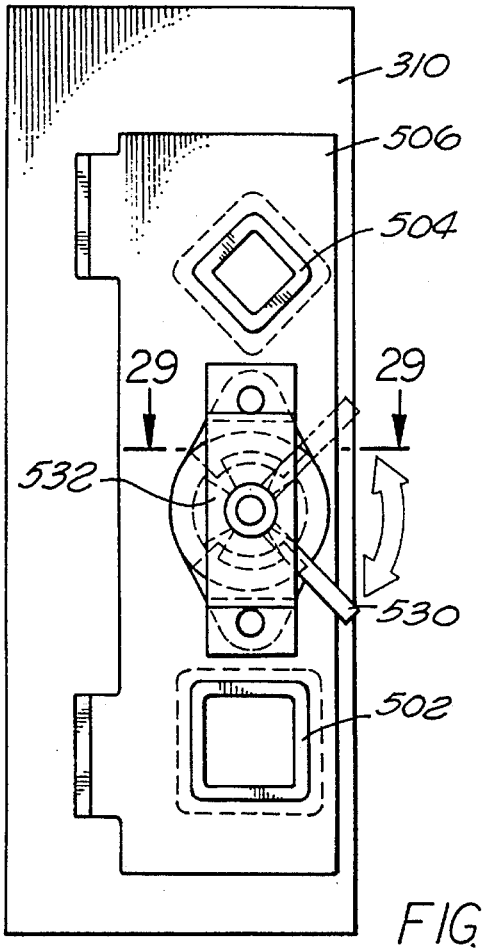
FIG. 27 is an enlarged elevational view of the camlock of FIG. 26.

An alternative to the arrangement of FIG. 30 is shown in FIG. 31 generally at 554, wherein cuff 556 is configured with an inwardly-disposed, central vertical slot 558. Instead of the wedge-shape member 550 extending down from the end of the cross rail 559, another wedge-shape configuration is provided as shown generally at 560. It is constructed as a separate member which is affixed to the end face of the cross rail member 498 and includes a wedge-shape member 562 secured by a vertical webbing 564 to a plate 566, which is attached to the end of the cross rail 559. Thereby, the wedge-shaped member 562, instead of extending down beneath the cross rail 559, is in the same lateral plane thereof. Thus, the wedge-shape member 562 fits down into the cup 570 and the webbing 564 fits down in through the slot 558 to releasably secure the cross rail 559 to the post 542.

Figure 32:
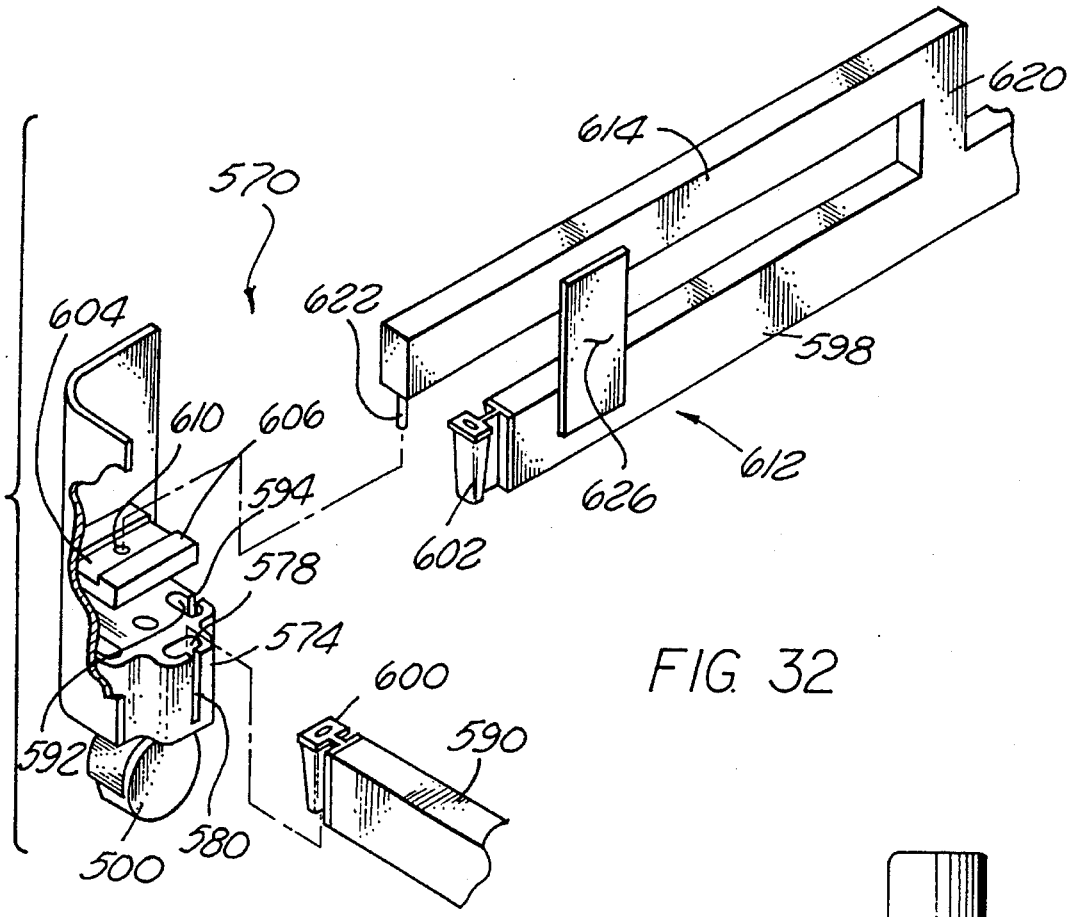
FIG. 32 is a view similar to FIG. 26 of a second alternative frame.
Figure 33:
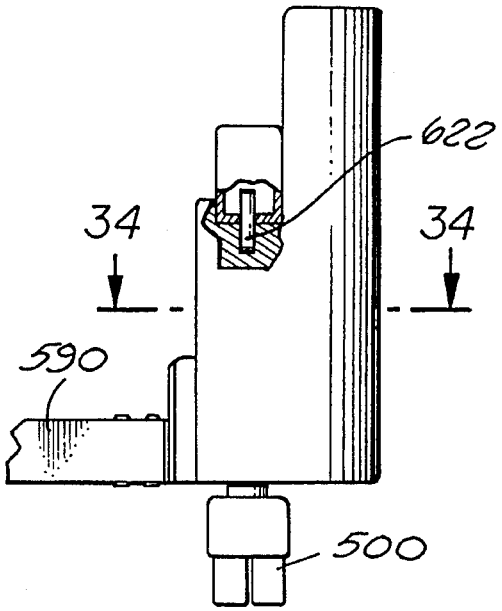
FIG. 33 is an end elevational view of a corner of the assembled frame of FIG. 32.
Figure 34:
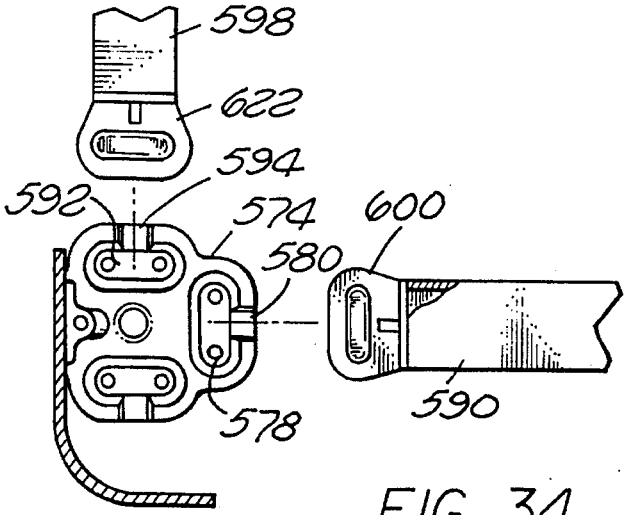
FIG. 34 is a partially exploded, cross-sectional view taken on line 34—34 of FIG. 33.

A still further method of connecting the longitudinal rails, cross rails, and corner posts to form a rectangular knock-down bed frame is shown in FIGS. 32–34 generally at 570, wherein it is seen that the cross rails, the longitudinal rails, and the support posts are all separable components. A (zinc) die east member 574 at the bottom of the support post 576 has an opening 578 with a slot 580 facing the cross rail 590 and a similar opening-slot arrangement 592, 594 facing the longitudinal rail 598. At the ends of the rails of both the longitudinal and cross rail members 590, 598 are wedge-shaped configurations 600, 602, respectively, similar to that shown in FIG. 31. These are configured and adapted to fit down into the corresponding openings 578, 592 and slots 580, 594 in the support post 576. As can be understood from FIG. 34, three opening-slots are shown so that a single die east member configuration can be used for all four posts. Above the lower cast member 574 is a plate 606 having a longitudinal channel 608 with a through-opening 610 in the center of it. The longitudinal rail assembly 612 includes a second rail member 614 spaced above the lower member 598, provided as the guide rail and connected by a connecting post 620 in a U-shaped arrangement. The end of the top member 614 extends a distance beyond the wedge-shaped configuration 602 and has a downward cylindrical pin 622. This pin 622 then fits into the opening 610 in the channel 608. A plate 626 connects the upper and lower rail members 614, 598 as shown in FIG. 32.

Figure 35:
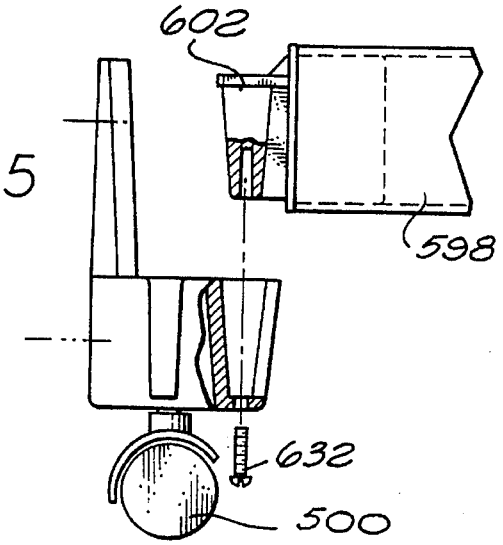
FIG. 35 is a side elevational view of the frame of FIG. 32 illustrated in a partially disassembled condition.

FIG. 35 shows an alternative embodiment wherein the wedge-shaped member when in the slot and receiving opening can be secured therein by an optional screw 632 which is passed up through an opening in the bottom of the cup and into the bottom of the wedge-shaped member. The screw 632 can be used to lock the joint tighter together and prevent the taper from wiggling out and unlocking.

Figure 36:
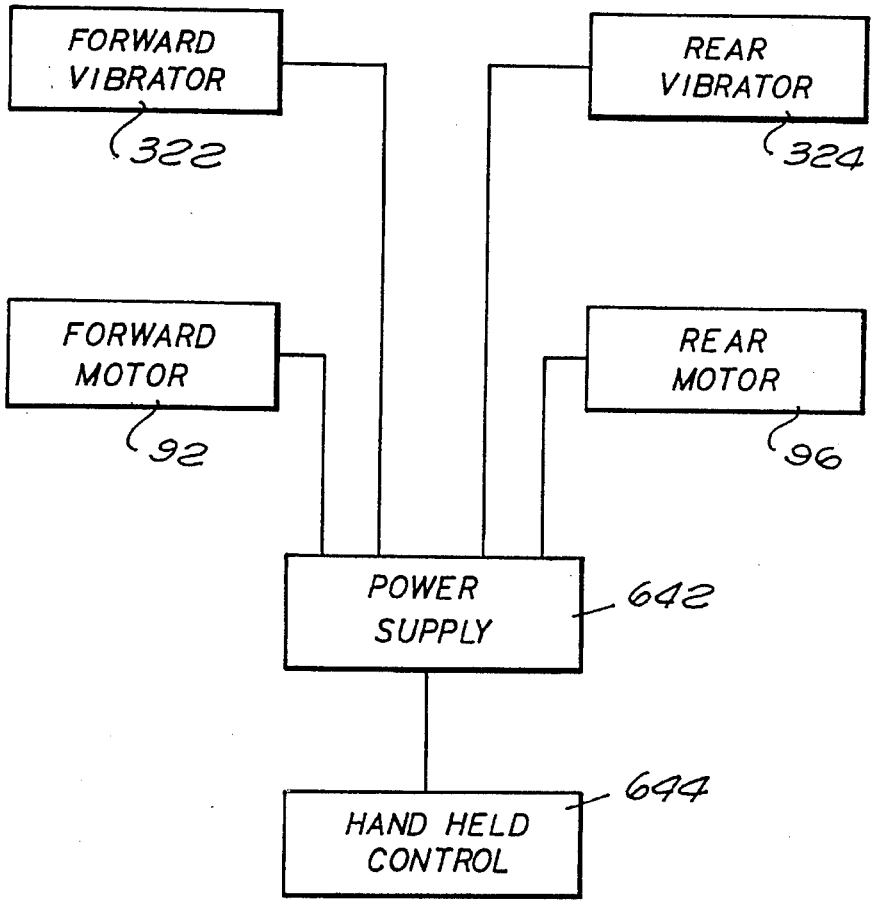
FIG. 36 is a simplified electrical schematic of the bed of FIG. 12.

FIG. 36 shows generally at 640 a simple electrical schematic of the bed 300. It shows a power supply 642, such as conventional one hundred and ten or two hundred and twenty volt power supplies operably connected to the forward and rear motors 92, 96 and the forward and rear vibrating motors 322, 324. The operations of these four motors are then controlled by a hand held control 644, held and operated by the user. Examples of remote control units which can be adapted for this bed are the "RM" and "RPS" units available from Maxwell Products, Inc. of Cerritos, Calif., and those disclosed in copending U.S. application Ser. No. 08/277,511, filed Jul. 19, 1994.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. An adjustable articulated bed, comprising:

a support frame including longitudinal support members, cross support members, and means for releasably snap-fit coupling said cross support members relative to said longitudinal support members;

a power module including a module body portion, a module head portion, and motor means for pivoting said module head portion relative to said module body portion;

means for releasably snap-fit coupling said power module to said frame for support thereby:

a mattress foundation including a foundation body section and a foundation head section;

means for releasably snap-fit coupling said foundation body section to said module body portion; and means for releasably snap-fit coupling said foundation head section to said module head portion.

2. The bed of claim 1 further comprising a first vibration motor mounted to and underneath said foundation body section, and a second vibration motor mounted to and underneath said foundation head section.

3. The bed of claim 1 further comprising a mattress supported by and on top of said mattress foundation.

4. The bed of claim 1 wherein said foundation body section includes lateral seat, thigh and lower leg sections articulated relative to one another.

5. The bed of claim 4 wherein said power module includes a foot support linkage assembly pivotally coupled at one end to said module body portion and at another end is snap-fit coupled in a pivotal arrangement to said lower leg section.

6. The bed of claim 1 wherein said mattress foundation includes a box spring.

7. The bed of claim 1 wherein said mattress foundation includes a mattress padding.

8. An adjustable articulated bed, comprising:

a support frame;

a power module supported by said support frame, said power module including a module base portion, a module head portion and a motor for pivoting said module head portion relative to said module base portion;

a first drag link part pivotally coupled to said module head portion at one end thereof and having an opposite first end;

a second drag link part pivotally coupled to said support frame at one end thereof and having an opposite second end; and fastening means for releasably fastening said first and second ends together to define when fastened together a continuous drag link extending between said module head portion and said support frame.

9. The bed of claim 8 wherein said fastening means comprises a snap-fit assembly.

10. The bed of claim 8 wherein said module head portion includes a mattress foundation head section and a mounting bracket attached to said mattress foundation head section, said one end of said first drag link part being pivotally connected to said mounting bracket.

11. The bed of claim 8 wherein when said first and second drag link parts are fastened together, one of said drag link parts is slid a distance into the other in a slid-in position, and said fastening means includes a spring-biased tab which fits in through aligned slots of said drag link parts with said drag link parts in the slid-in position.

12. An adjustable articulated bed, comprising:

left and right longitudinal frame assemblies;

head and foot cross frame assemblies;

means for releasably snap-fit securing said cross frame assemblies to said left and right longitudinal frame assemblies to thereby form a bed frame;

a power drive module having head and body portions;

means for releasably snap-fit securing said power drive module to said frame;

a mattress foundation head section;

means for releasably snap-fit securing said mattress foundation body section on and to said head portion;

a mattress foundation body section; and means for releasably snap-fit securing said mattress foundation body section on and to said body portion.

13. The bed of claim 12 wherein said power drive module can operatively slide relative to said frame.

14. The bed of claim 12 further comprising a drag link assembly pivotally connecting said mattress foundation head section to said head cross frame assembly.

15. The bed of claim 14 further comprising snap-fit means for releasably snap-fit securing said drag link assembly in position relative to said mattress foundation head section and said cross frame assembly.

16. The bed of claim 12 wherein said left and right longitudinal frame assemblies both include head and foot upright frame posts.

17. The bed of claim 12 wherein said head and foot cross frame assemblies both include a pair of upright frame posts.

18. The bed of claim 12 wherein said body portion includes an opening and said mattress foundation body section includes a spring clip releasably securable into said opening.

19. The bed of claim 18 wherein said body portion includes a slot and said mattress foundation body section includes a hook releasably securable in said slot, and with said hook engaged in said slot, said spring clip can be press-fitted into said opening.

20. An adjustable articulated bed, comprising:

a bed frame assembly;

a bedding foundation assembly supported by said bed frame assembly, said foundation assembly including a foundation body section and a foundation head section operatively moveable relative to said foundation body section;

slot means, positioned secured to said foundation head section and moveable therewith, for defining an elongate slot generally beneath and parallel to said foundation head section; and a link assembly pivotally coupled at one end to said bed frame assembly and having a slide member at an opposite end thereof, said slide member being disposed in and sliding along said elongate slot as said foundation head section is operatively moved relative to said foundation body section.

21. The bed of claim 20 wherein said slide member comprises a square bushing.

22. The bed of claim 21 wherein said square bushing includes a flexible finger to prevent rattling.

23. The bed of claim 20 wherein said link assembly comprises a primary hinge, and said slot means comprises a secondary hinge.

24. An adjustable articulated bed, comprising:

a knock-down bed frame;

a power module supported by said bed frame; and a bedding foundation supported by said bed frame and including a foundation body portion and a foundation head portion, said power module being capable of controllably moving said head portion relative to said body portion;

wherein said bed frame includes right and left head corner posts and right and left foot corner posts, a left longitudinal rail secured at one end to said left head corner post and an opposite end to said left foot corner post, a right longitudinal rail secured at one end to said right head corner post and at an opposite end to said right foot corner post, a head lateral rail, a foot lateral rail, inward and laterally disposed, downwardly-tapered cups formed at bottom ends of each said corner post, and a downwardly-disposed wedge-shaped member at both ends of said head and foot lateral rails for engaging down in respective ones of said cups for releasably securing together said corner posts and said lateral rails.

25. The bed of claim 24 wherein said wedge-shaped members extend downwardly from said ends of said lateral rails.

26. The bed of claim 24 wherein said wedge-shaped members are secured laterally at lateral ends of said lateral rails.

27. The bed of claim 26 wherein said wedge-shaped members are each connected with vertical web members to said rail ends, and each of said cups has a vertical slot, down into which a respective said web member fits.

28. An adjustable articulated bed, comprising:

a knock-down bed frame;

a power module supported by said knock-down bed frame; and a bedding foundation supported by said bed frame and including a foundation body portion and a foundation head portion, said power module controllably moving said head portion relative to said body portion;

wherein said bed frame includes left and right head corner posts secured together with a head lateral rail, left and right foot corner posts secured together with a foot lateral rail, left and right longitudinal rail assemblies, and locking means for releasably locking ends of said left and right longitudinal rail assemblies in openings in respective said corner posts.

29. The bed of claim 28 wherein said locking means includes a rotatable locking mechanism.

30. The bed of claim 28 wherein said longitudinal rail assemblies both include head and foot plates and said locking means includes clamps which clamp said plates to respective corner posts.

31. The bed of claim 28 wherein said longitudinal rail assemblies both include respective guide rails along which said power module operatively glides.

32. An adjustable articulated bed, comprising:

a bed frame having longitudinal rails;

a carriage supported by said bed frame;

a motor for moving said carriage, relative to said bed frame, to adjustable configure a bed mattress supported thereon generally as desired by a user; and a plurality of snap-together glide joints releasably snap-securing said carriage to said longitudinal rails for gliding movement of said carriage relative to said bed frame by the operation of said motor.

33. The bed of claim 32 wherein said bed frame includes cross rails and corner posts, said cross rails include end tapered male castings which releasably snap fit into openings in said corner posts.

34. The bed of claim 32 further comprising a foundation assembly for supporting the mattress and tab-and-slot means for releasably snapping said foundation assembly to said carriage.

35. The bed of claim 32 wherein each said snap-together glide joint includes a top roller positionable on top of said longitudinal rail, a bottom roller positionable for rolling engagement on a lower surface of said longitudinal rail, and a frame releasably securing said top and bottom rollers in position relative to one another and to said longitudinal rail.

36. The bed of claim 35 wherein each said snap-together glide joint includes a spring clip releasably securing said bottom roller relative to said frame.

37. An adjustable articulated bed, comprising:

a support frame including corner legs, longitudinal supports, a head end lateral support and a foot end lateral support;

a power module supported by said frame and slidable along and relative to said longitudinal supports, said power module including a module body portion, a module head portion and a motor for pivoting said module head portion relative to said module body portion, said power module sliding along said longitudinal supports as said module head portion is pivoted by said motor;

a drag link pivotally coupled at one end to said frame and at an opposite end to said module head portion; and slide means for sliding said power module along said longitudinal supports;

wherein said slide means includes a top roller wheel riding on top of one of said longitudinal supports and a bottom roller wheel riding on the bottom of one of said longitudinal supports.

38. The bed of claim 37 wherein said slide means includes holding means for holding said top and bottom roller wheels in relative position and to said power module.

39. The bed of claim 38 wherein said slide means includes a third roller wheel riding on said one said longitudinal support with said top roller wheel and said bottom member and in a triangular relationship therewith.

40. The bed of claim 37 further comprising a mattress foundation including a foundation body section and a foundation head section pivotal relative to said foundation body section, said foundation body section being secured to said module body portion, and said foundation head section being secured to said module head portion.

41. The bed of claim 37 wherein said drag link is pivotally coupled to said head end lateral support.

42. The bed of claim 41 further comprising a mounting member mounted upright to said head end lateral support, and said drag link is pivotally coupled to a top end of said mounting member.

43. The bed of claim 42 wherein said mounting member defines an "A" shape with its legs straddling said head end lateral support.

44. An adjustable articulated bed, comprising:

a support frame including corner legs, longitudinal supports, a head end lateral support and a foot end lateral support;

a power module supported by said frame and slidable along and relative to said longitudinal supports, said power module including a module body portion, a module head portion and a motor for pivoting said module head portion relative to said module body portion, said power module sliding along said longitudinal supports as said module head portion is pivoted by said motor;

a drag link pivotally coupled at one end to said frame and at an opposite end to said module head portion; and slide means for sliding said power module along said longitudinal supports;

wherein said longitudinal supports have diamond-shaped lateral cross-sections, and said slide means includes a V-shaped roller assembly which rolls on said diamond-shaped longitudinal supports.

45. The bed of claim 44 further comprising a mattress foundation including a foundation body section and a foundation head section pivotal relative to said foundation body section, said foundation body section being secured to said module body portion, and said foundation head section being secured to said module head portion.

46. The bed of claim 45 wherein said module head portion includes a pivot member pivotally coupled at a foot end thereof to said module base portion, a slide member attached to said pivot member, and a slotted member secured to said foundation head section, said slotted member defining an elongate slot in which said slide member slides as said foundation head section is pivoted relative to said foundation body section.

47. The bed of claim 46 wherein said slide member comprises a square bushing.

48. The bed of claim 44 wherein said drag link is pivotally coupled to said head end lateral support.

49. An adjustable articulated bed, comprising:

a support frame including corner legs, longitudinal supports, a head end lateral support and a foot end lateral support;

a power module supported by said frame and slidable along and relative to said longitudinal supports, said power module including a module body portion, a module head portion and a motor for pivoting said module head portion relative to said module body portion, said power module sliding along said longitudinal supports as said module head portion is pivoted by said motor;

a drag link pivotally coupled at one end to said frame and at an opposite end to said module head portion; and a mattress foundation including a foundation body section and a foundation head section pivotal relative to said foundation body section, said foundation body section being secured to said module body portion, and said foundation head section being secured to said module head portion;

wherein said module head portion includes a pivot member pivotally coupled at a foot end thereof to said module base portion, a slide member attached to said pivot member, and a slotted member secured to said foundation head section, said slotted member defining an elongate slot in which said slide member slides as said foundation head section is pivoted relative to said foundation body section.

50. The bed of claim 49 wherein said slide member comprises a square bushing.

51. The bed of claim 49 wherein said drag link is pivotally coupled to said head end lateral support.

52. The bed of claim 51 further comprising a mounting member mounted upright to said head end lateral support, and said drag link is pivotally coupled to a top end of said mounting member.

53. The bed of claim 52 wherein said mounting member defines an "A" shape with its legs straddling said head end lateral support.

54. An adjustable articulated bed, comprising:

a support frame including corner legs, longitudinal supports, a head end lateral support and a foot end lateral support;

a power module supported by said frame and slidable along and relative to said longitudinal supports, said power module including a module body portion, a module head portion and a motor for pivoting said module head portion relative to said module body portion, said power module sliding along said longitudinal supports as said module head portion is pivoted by said motor;

a drag link pivotally coupled at one end to said frame and at an opposite end to said module head portion;

wherein said drag link is pivotally coupled to said head end lateral support; and a mounting member mounted upright to said head end lateral support, and said drag link is pivotally coupled to a top end of said mounting member;

wherein said mounting member defines an "A" shape with its legs straddling said head end lateral support.

55. The bed of claim 54 further comprising slide means for sliding said power module along said longitudinal supports.

56. The bed of claim 55 wherein said slide means includes a top roller wheel riding on top of one of said longitudinal supports and a bottom roller wheel riding on the bottom of one of said longitudinal supports.

57. The bed of claim 56 wherein said slide means includes holding means for holding said top and bottom roller wheels in relative position and to said power module.

58. The bed of claim 57 wherein said slide means includes a third roller wheel riding on said one said longitudinal support with said top and bottom roller wheels and in a triangular relationship therewith.

59. The bed of claim 55 wherein said longitudinal supports have diamond-shaped lateral cross-sections, and said slide means includes a V-shaped roller assembly which rolls on said diamond-shaped longitudinal supports.

60. The bed of claim 54 further comprising a mattress foundation including a foundation body section and a foundation head section pivotal relative to said foundation body section, said foundation body section being secured to said module body portion, and said foundation head section being secured to said module head portion.

61. The bed of claim 60 wherein said module head portion includes a pivot member pivotally coupled at a foot end thereof to said module base portion, a slide member attached to said pivot member, and a slotted member secured to said foundation head section, said slotted member defining an elongate slot in which said slide member slides as said foundation head section is pivoted relative to said foundation body section.

62. The bed of claim 61 wherein said slide member comprises a square bushing.

63. An adjustable articulated bed, comprising:

a support frame including support posts, head and foot cross members, and opposite longitudinal members;

a power module supported by said support frame, said power module including a module body portion and a motorized module head portion pivotal relative thereto;

a matress foundation assembly supported by said power module; and a roller slide assembly on which said power module slides on one of said longitudinal members relative to said support posts;

wherein said roller slide assembly includes a top roller riding on top of said one of said longitudinal members;

wherein said roller slide assembly includes a bottom roller held in position generally roll on the bottom of said one said longitudinal member; and wherein said roller slide assembly includes holding means for holding said bottom and top rollers relative to each other and in operative position relative to said one said longitudinal member.

64. The bed of claim 63 wherein said holding means includes snap-fit means for snap-fit securing and releasing said bottom roller relative to said top roller such that said power module can be moved between operative and inoperative positions relative to said support frame.

65. The bed of claim 63 further comprising a pivotal drag link assembly operatively interconnecting said frame and said module head portion.

66. The bed of claim 65 wherein said pivotal drag link assembly includes a drag link pivotally coupled at one end thereof to said head cross member.

67. The bed of claim 63 wherein each said support post includes a straight-pin receiving opening and first and second wedge-shaped pin receiving openings, each said longitudinal member includes at each opposite end thereof a downwardly-disposed straight pin for disposition in a respective said straight-pin receiving opening and a downwardly-disposed wedge-shaped pin for disposition in a respective said first wedge-shaped pin receiving opening, and each said cross member includes at each opposite end thereof a downwardly-disposed wedge-shaped pin for disposition in a respective said second wedge-shaped pin receiving opening.

68. An adjustable articulated bed, comprising:

a support frame including support posts, head and foot cross members, and opposite longitudinal members;

a power module supported by said support frame, said power module including a module body portion and a motorized module head portion pivotal relative thereto; a mattress foundation assembly supported by said power module; and a roller slide assembly on which said power module slides on one of said longitudinal members relative to said support posts;

wherein each said support post includes a straight-pin receiving opening and first and second wedge-shaped pin receiving openings, each said longitudinal member includes at each opposite end thereof a downwardly-disposed straight pin for disposition in a respective said straight-pin receiving opening and a downwardly-disposed wedge-shaped pin for disposition in a respective said first wedge-shaped pin receiving opening, and each said cross member includes at each opposite end thereof a downwardly-disposed wedge-shaped pin for disposition in a respective said second wedge-shaped pin receiving opening.

69. The bed of claim 68 wherein said roller slide assembly includes a top roller riding on top of said one of said longitudinal members.

70. The bed of claim 69 wherein said roller slide assembly includes a bottom member held in position to generally engage on the bottom of said one said longitudinal member.

71. The bed of claim 68 further comprising a pivotal drag link assembly operatively interconnecting said frame and said module head portion.

72. The bed of claim 71 wherein said pivotal drag link assembly includes a drag link pivotally coupled at one end thereof to said head cross member.

73. A method of assembling an adjustable articulated bed, comprising the steps of:

assembling separate longitudinal and lateral rail assemblies together to form a bed frame using releasable wedge-type connections between said rail assemblies;

attaching a motorized carriage to the longitudinal rail assemblies;

securing an articulated foundation body assembly to the carriage; and securing a foundation head assembly to the carriage.

74. The method of claim 73 further comprising attaching a drag link pivotally between a head one of the lateral rail assemblies and the foundation head assembly.

75. A method of assembling an adjustable articulated bed, comprising the steps of:

assembling separate longitudinal and lateral rail assemblies together to form a bed frame;

attaching with releasable spring clips a motorized carriage to the longitudinal rail assemblies;

securing an articulated foundation body assembly to the carriage; and securing a foundation head assembly to the carriage.

76. A method of assembling an adjustable articulated bed, comprising the steps of:

assembling separate longitudinal and lateral rail assemblies together to form a bed frame;

attaching a motorized carriage to the longitudinal rail assemblies;

securing an articulated foundation body assembly to the carriage; and securing a foundation head assembly to the carriage;

wherein said attaching step uses releasable spring clips.

77. The method of claim 76 further comprising attaching a drag link pivotally between a head one of the lateral rail assemblies and the foundation head assembly.

78. The method of claim 77 wherein said drag link attaching step includes attaching together first and second elongated drag link parts.

79. A method of assembling an adjustable articulated bed, comprising the steps of:

assembling separate longitudinal and lateral rail assemblies together to form a bed frame;

attaching a motorized carriage to the longitudinal rail assemblies;

securing with snap-fit connectors an articulated foundation body assembly to the carriage; and securing with snap-fit connectors a foundation head assembly to the carriage.

80. The method of claim 79 further comprising attaching a drag link pivotally between a head one of the lateral rail assemblies and the foundation head assembly.

81. The method of claim 80 wherein said drag link attaching step includes attaching together first and second elongated drag link parts.

82. A method of assembling an adjustable articulated bed, comprising the steps of:

assembling separate longitudinal and lateral rail assemblies together to form a bed frame;

attaching a motorized carriage to the longitudinal rail assemblies;

securing an articulated foundation body assembly to the carriage;

securing a foundation head assembly to the carriage; and attaching a drag link pivotally between the head one of the lateral rail assemblies and the foundation head assembly;

wherein said drag link attaching step includes attaching together first and second elongated drag link parts.

* * * * *